US007740046B2

(12) United States Patent
Goodman et al.

(10) Patent No.: US 7,740,046 B2
(45) Date of Patent: Jun. 22, 2010

(54) METHOD, APPARATUS AND SYSTEM FOR CONTROLLING A MOVABLE PARTITION

(75) Inventors: E. Carl Goodman, Bountiful, UT (US); D. George Field, Pleasant Grove, UT (US); Kevin D. Banta, Highland, UT (US)

(73) Assignee: Won-Door Corporation, Salt Lake City, UT (US)

( * ) Notice: Subject to any disclaimer, the term of this patent is extended or adjusted under 35 U.S.C. 154(b) by 323 days.

(21) Appl. No.: 11/796,325

(22) Filed: Apr. 27, 2007

(65) Prior Publication Data

US 2008/0264578 A1 Oct. 30, 2008

(51) Int. Cl.
*E05F 15/00* (2006.01)

(52) U.S. Cl. ..... 160/188; 280/124.1

(58) Field of Classification Search ..... 160/1, 160/196.1, 188, 199, 201, 84.02, 84.08; 180/434–437; 105/163.2; 280/43.17, 124.1
See application file for complete search history.

(56) References Cited

U.S. PATENT DOCUMENTS 3,972,381 A * 8/1976 Gail ..... 180/401
5,828,972 A * 10/1998 Asanuma et al. ..... 701/41
6,708,094 B2 * 3/2004 Charaudeau et al. ..... 701/37
7,478,663 B2 * 1/2009 Goodman et al. ..... 160/188
7,513,293 B2 * 4/2009 Goodman et al. ..... 160/188
2005/0217802 A1 10/2005 Goodman et al.
2007/0152427 A1 * 7/2007 Olsen ..... 280/649
2008/0115896 A1 * 5/2008 Goodman ..... 160/199
2008/0264578 A1 * 10/2008 Goodman et al. ..... 160/202

FOREIGN PATENT DOCUMENTS

DE 20 2005 000 165 U1 3/2006
WO 2005098189 10/2005

OTHER PUBLICATIONS

PCT International Search Report for Application No. PCT/US2008/061167, dated Oct. 14, 2008.

* cited by examiner

*Primary Examiner*—Blair M. Johnson
(74) *Attorney, Agent, or Firm*—TraskBritt

(57) ABSTRACT

Various apparatuses, methods and systems for directionally controlling a movable partition are provided. In one embodiment, an apparatus may include at least one roller assembly coupled to a portion of a movable partition. A roller element of the roller assembly may be configured to maintain contact with an adjacent surface (e.g., a floor) while the partition is displaced along a desired path even though the adjacent surface may exhibit unevenness, undulations or other substantially nonplanar surface features. In one embodiment, the apparatus may be configured to maintain a substantially constant force between the roller element and the adjacent surface. In another embodiment, the apparatus may be configured to maintain a force between the roller element and the adjacent surface substantially within a specified range. A steering actuator may also be used to select, or change, the orientation of the roller assembly with respect to the partition.

16 Claims, 24 Drawing Sheets

400

470
402
474
469
446
484
116
482
480
478
476
450
448
408
406
456
444
102
490
504

METHOD, APPARATUS AND SYSTEM FOR CONTROLLING A MOVABLE PARTITION

BACKGROUND OF THE INVENTION

1. Field of the Invention

The present invention generally relates to movable partitions and, more particularly, to the control of such partitions including, for example, foldable doors.

2. State of the Art

Movable partitions are utilized in numerous situations and environments for a variety of purposes. Such partitions may include, for example, foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security and/or fire barrier. In such a case, the door may be configured to automatically close upon the occurrence of a predetermined event such as the actuation of an associated alarm. For example, one or more accordion or similar folding-type doors may be used as a security and/or a fire door wherein each door is formed with a plurality of panels hingedly connected to one another. The hinged connection of the panels allows the door to fold up in a compact unit for purposes of storage when not deployed. Thus, the door may be stored, for example, in a pocket formed in the wall of a building when in a retracted or folded state. When deployment of the door is required to secure an area during a fire or for any other specified reason, the door is driven by a motor along a track, conventionally located above the door in a header, until the door is extended a desired distance across the room to form an appropriate barrier.

When deployed, a leading edge of the door, which may be defined by a component known as a lead post, complementarily engages a receptacle in a fixed structure, such as a wall, or in a mating receptacle of another door. Such a receptacle may be referred to as a jamb or a door post when formed in a fixed structure, or as a mating lead post when formed in another door. It is desirable that the lead post be substantially aligned with the mating receptacle such that the door may be completely closed and an appropriate seal formed between the door and mating receptacle. For example, if the door is being used as a fire door, it is desirable that the lead post of a door is fully engaged with the mating receptacle to prevent drafts and any attendant flames or smoke from traversing the barrier formed by the partition and, more particularly, the joint formed by the lead post and receptacle.

In some cases, the lower edge of the door, including, perhaps, the lower edge of the door's lead post, may be laterally displaced relative to the top edge of the door which is relatively fixed in a lateral sense due to its engagement with the track and header. Such lateral displacement of the door's lower edge may be caused, for example, by a fire-induced draft, by an improperly balanced HVAC system, or simply from an occupant of a room pushing against the door while it is being deployed. If the lower edge of the lead post is laterally displaced relative to its upper edge as the leading edge of the door approaches the mating receptacle, the lead post will not be properly aligned with the mating receptacle and an appropriate seal will not be formed. In other words, the mating receptacle is conventionally installed to be substantially plumb. If the lower edge of a lead post of a door is laterally displaced relative to its upper edge, the lead post is not plumb (or substantially vertically oriented) and thus will not properly engage the substantially plumb receptacle.

As noted above, the failure of the lead post to properly engage the receptacle may have substantial consequences when, for example, the door is being used as a fire or security barrier. At a minimum, even when the door is not used as a fire or security barrier, the failure of the lead post to properly engage the mating receptacle will result in the inability to completely subdivide a larger room and visually or acoustically isolate the subdivided room.

One approach to preventing or controlling the lateral displacement of a lower edge of the door has included forming a guide track within the floor of a room and then causing the door or barrier to engage the track as it is deployed and retracted such that the door is laterally constrained relative to the path of the track. However, the placement of a track in the floor of a room is not an ideal solution for all environments. For example, such a track provides a place for collection of dust and debris and may, thereby, become an unsightly feature of the room. In some cases, the collection of debris may affect the proper operation of the door itself. Additionally, the existence of a track in the floor, regardless of whether it is protruding from the floor or recessed within the floor, may act as a hazard or potential source of injury depending, for example, on the intended use of the area and the actual location of the floor track within that area.

Moreover, even if one were to use a track in the floor, floors often exhibit an undesirable amount of unevenness presenting additional difficulties. For example, it becomes difficult to install an even and level track in a floor or other supporting surface that is not even. If the track is not substantially even and level, the bottom edge of the partition, or some component associated therewith, may have trouble maintaining engagement with the track while it is being displaced. Likewise, other devices that may attempt to maintain engagement with (or maintain some other specified relationship with) an adjacent or an underlying surface may experience difficulty doing so due to the unevenness and undulating nature of such a surface.

In view of the current state of the art, it would be advantageous to provide methods, apparatuses and systems for directionally controlling movable barriers including, for example, extendable and retractable partitions. For example, in directionally controlling a movable partition or barrier, it would be advantageous to enable automatic control of the partition or barrier with respect to any lateral displacement of the lower edge of the barrier relative to the upper edge of the barrier without requiring the installation of an additional track in the floor.

BRIEF SUMMARY OF THE INVENTION

The present invention is directed to apparatuses, systems and methods for controlling movable partitions including controlling displacement of movable partitions. For example, certain embodiments include apparatuses, systems or methods for reorienting a movable partition (or a portion thereof) or for maintaining a movable partition (or portion thereof) in a desired orientation.

In accordance with one embodiment of the invention, an apparatus for directionally controlling a movable partition is provided. The apparatus includes a frame member configured to be coupled to a portion of the movable partition. At least one roller assembly is coupled with the frame member and includes at least one roller element. A steering actuator is operatively coupled with the at least one roller assembly and configured to alter the orientation of the at least one roller assembly relative to the frame member. In one embodiment, one or more sensors that are located and configured to determine the vertical orientation of at least a section of the movable partition may be associated with the apparatus. The sensor (or sensors) may generate a signal representative of the vertical orientation of at least a portion of the movable partition and transmit the signal to a controller. The controller may then control the steering actuator to alter, if appropriate, the orientation of the at least one roller assembly relative to the frame member to bring the at least a portion of the movable partition back to a substantially vertical orientation. In another embodiment, the apparatus may be used for steering the partition along a specified pathway.

In accordance with another embodiment of the present invention, an automatic door is provided. The automatic door includes at least one partition, a drive configured to motivate the partition along a defined pathway, and a directional control apparatus coupled to a lower edge of the at least one partition. The directional control apparatus includes at least one roller assembly coupled to the at least one partition. A steering actuator is operatively coupled with the at least one roller assembly and configured to alter the orientation of the at least one roller assembly relative to the at least one partition. Additionally, one or more sensors that are located and configured to determine the vertical orientation of at least a section of the at least one partition may be associated with the directional control device. The sensor (or sensors) may generate a signal representative of the vertical orientation of the at least a section of the at least one partition and transmit the signal to a controller. The controller may then control the steering actuator to alter, if appropriate, the orientation of the at least one roller assembly relative to the at least one partition to bring the at least a section of the at least one partition back to a substantially vertical orientation.

In accordance with yet another embodiment of the present invention, a system may be provided that includes the apparatus for directionally controlling a movable partition. The system may include one or more movable partitions and may include a controller operatively coupled with the apparatus.

In accordance with a further embodiment of the present invention, a method of controlling a movable partition is provided. The method includes sensing a current orientation of at least a section of the movable partition and, upon sensing that the current orientation of the at least a section of the movable partition is substantially deviated from a desired orientation of the at least a section, displacing at least a portion of the at least a section of the movable partition until the at least a section of the movable partition is substantially at the desired orientation. In one embodiment the desired orientation may be a substantially plumb orientation. As used herein, the term "substantially out of plumb" means out of plumb by an unacceptable magnitude. The method may further include determining whether the movable partition is moving forward or in reverse along a defined pathway. Additionally, the method may include determining whether the defined pathway includes a curved portion.

In accordance with another method of the present invention, controlling a movable partition includes guiding a first edge of the movable partition along a defined pathway which includes at least one curved portion. At least one roller assembly is coupled to a section of the movable partition adjacent a second edge thereof. The direction of movement of the movable partition along the defined pathway is determined and a relative location of the section of the movable partition along the defined pathway is also determined. The at least one roller assembly is selectively steered as the section of the movable partition traverses through the at least one curved portion of the defined pathway.

In accordance with another embodiment of the present invention, an apparatus for controlling displacement of a movable partition is provided. The apparatus includes at least one roller assembly comprising at least one roller element. A mounting bracket is configured to be coupled to a portion of the movable partition. An actuator is coupled to the mounting bracket and operably associated with the at least one roller assembly. The actuator is configured to selectively displace the at least one roller element relative to the mounting bracket. In certain embodiments of the invention, the apparatus may be configured to determine the magnitude of a force applied between the actuator and the roller element. The linear actuator may then be configured to selectively displace the roller element responsive to the determined force.

In yet another embodiment, the apparatus may further include a steering actuator configured to rotationally displace the roller element about a steering axis. A sensor may be used to determine a current orientation of the partition (or at least a portion thereof). The steering actuator may then rotationally displace the roller element responsive, at least in part, to the determined orientation of the partition.

In accordance with yet a further embodiment of the present invention, an automatic door is provided. The automatic door includes at least one partition and a drive configured to motivate the at least one partition along a defined pathway. An apparatus is coupled to a lower edge of the at least one partition and includes at least one roller assembly comprising at least one roller element. An actuator is operatively coupled with the at least one roller assembly and configured to selectively alter the position of the at least one roller element relative to the lower edge of the at least one partition.

In certain embodiments of the invention, the apparatus associated with the door may be configured to determine the magnitude of a force applied between the actuator and the roller element. The linear actuator may then be configured to selectively displace the roller element responsive to the determined force.

In other embodiments, the apparatus may further include a steering actuator configured to rotationally displace the roller element about a steering axis. A sensor may be used to determine a current orientation of the door (or at least a portion thereof). The steering actuator may then rotationally displace the roller element responsive, at least in part, to the determined orientation of the door.

In accordance with other embodiments of the present invention, a system may be provided that includes the apparatuses for controlling a movable partition. The system may include one or more movable partitions and may include a controller operatively coupled with the apparatus.

In accordance with yet another embodiment of the present invention, a method is provided for controlling a movable partition. The method includes coupling at least one roller assembly to a portion of the movable partition and positioning at least one roller element of the at least one roller assembly in contact with a surface of an adjacent structure which the at least one partition will traverse, wherein the surface of the adjacent structure includes at least one substantially nonplanar surface feature. The movable partition is displaced in a first direction along a path adjacent the surface of the adjacent structure and contact between the at least one roller element and the surface of the adjacent structure is maintained while the at least one element traverses the at least one substantially nonplanar surface feature. The method may further include maintaining a substantially constant force, or a force within a specified range, between the roller element and the adjacent surface while the partition is being displaced.

In accordance with another method of controlling a movable partition that is provided by the present invention, at least one roller assembly is coupled to a portion of the movable partition and the movable partition is displaced such that it traverses an adjacent surface of a structure. Contact between at least one roller element of the at least one roller assembly is maintained with the adjacent surface while the movable partition is being displaced regardless of the surface geometry of the adjacent surface. The method may further include maintaining a substantially constant force, or a force within a specified range, between the at least one roller element and the surface of the adjacent structure while displacing the movable partition.

In accordance with yet another embodiment of the present invention, a further method of controlling a movable partition is provided. The method includes sensing a current orientation of at least a section of the movable partition and, upon sensing that the current orientation of the at least a section of the movable partition is substantially deviated from a desired orientation of the at least a section, displacing at least a portion of the at least a section of the movable partition until the at least a section of the movable partition is substantially at the desired orientation. In one embodiment the desired orientation may be a substantially plumb orientation. As used herein, the term "substantially out of plumb" means out of plumb by an unacceptable magnitude. Apparatuses and systems for accomplishing the method are also provided.

Another embodiment of the present invention includes at least one partition and a drive configured to motivate the at least one partition over the surface of a structure and along a defined pathway. At least one roller element is coupled with the at least one partition and configured for engagement with the surface of the structure. At least one steering actuator is coupled with the at least one roller element. A magnetic structure that is configured to generate a magnetic field is disposed adjacent the surface of the structure and extends substantially parallel to the defined pathway. At least one magnetic sensor is configured to detect a change in the strength of the magnetic field and generate a signal representative of a change in the strength of the magnetic field. The steering actuator is configured to selectively alter a direction of the at least one roller element responsive to the signal generated by the sensor.

In another method of the present invention, another method of controlling a movable partition is provided. The method includes defining a pathway of the movable partition over a surface of a structure. A magnetic structure is disposed along the defined pathway adjacent the surface of the structure. A lateral proximity of at least a portion of the movable partition relative to the magnetic structure is determined. Upon sensing that the lateral proximity of the least a portion of the movable partition is substantially deviated from a desired lateral proximity, the at least a portion of the movable partition is displaced until the at least a portion of the movable partition is substantially at the desired lateral proximity.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1A:
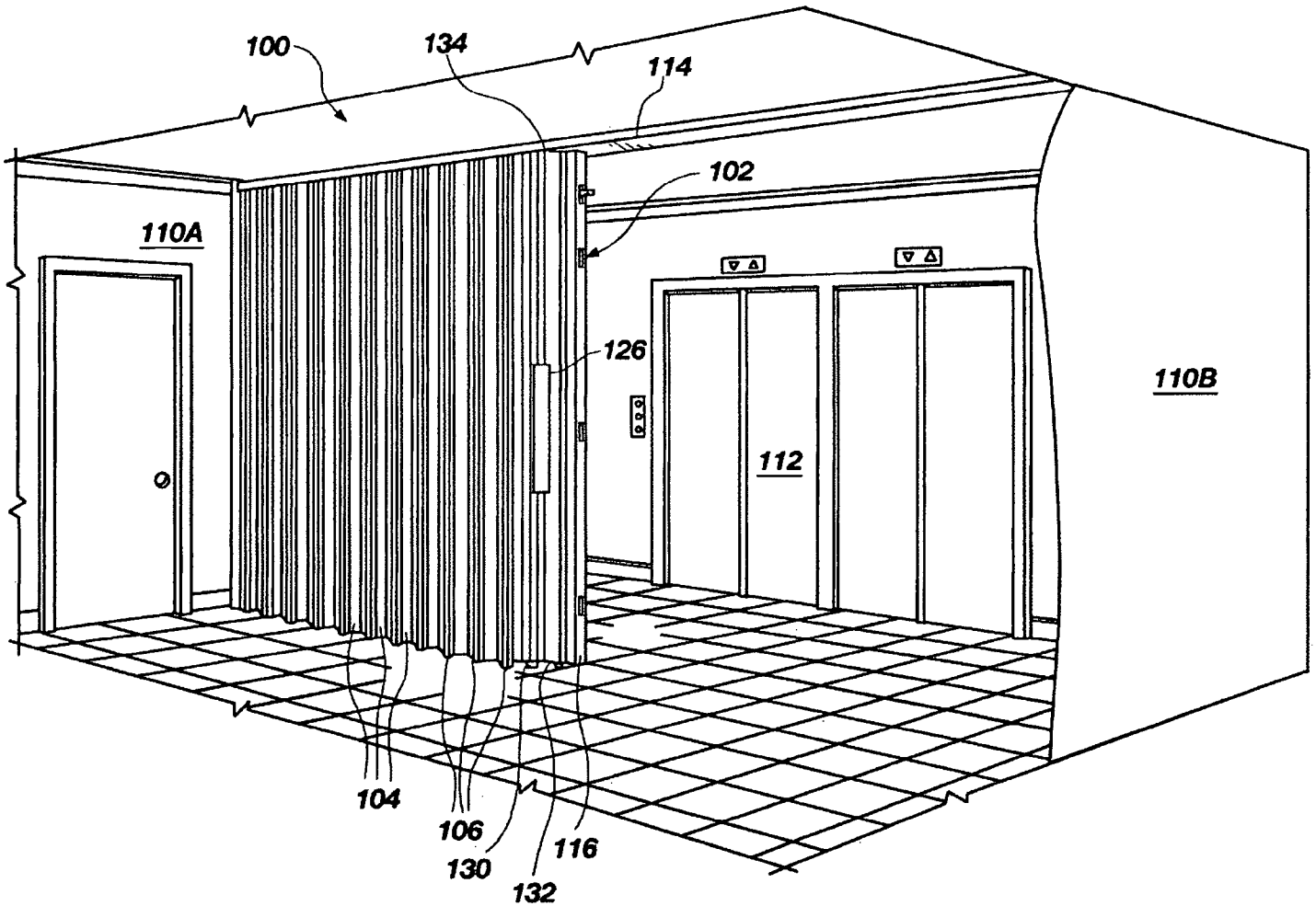
FIGS. 1A-1C show a perspective view, a plan view and an elevational view, respectively, of a system with a movable partition in accordance with an embodiment of the present invention.
Figure 1B:
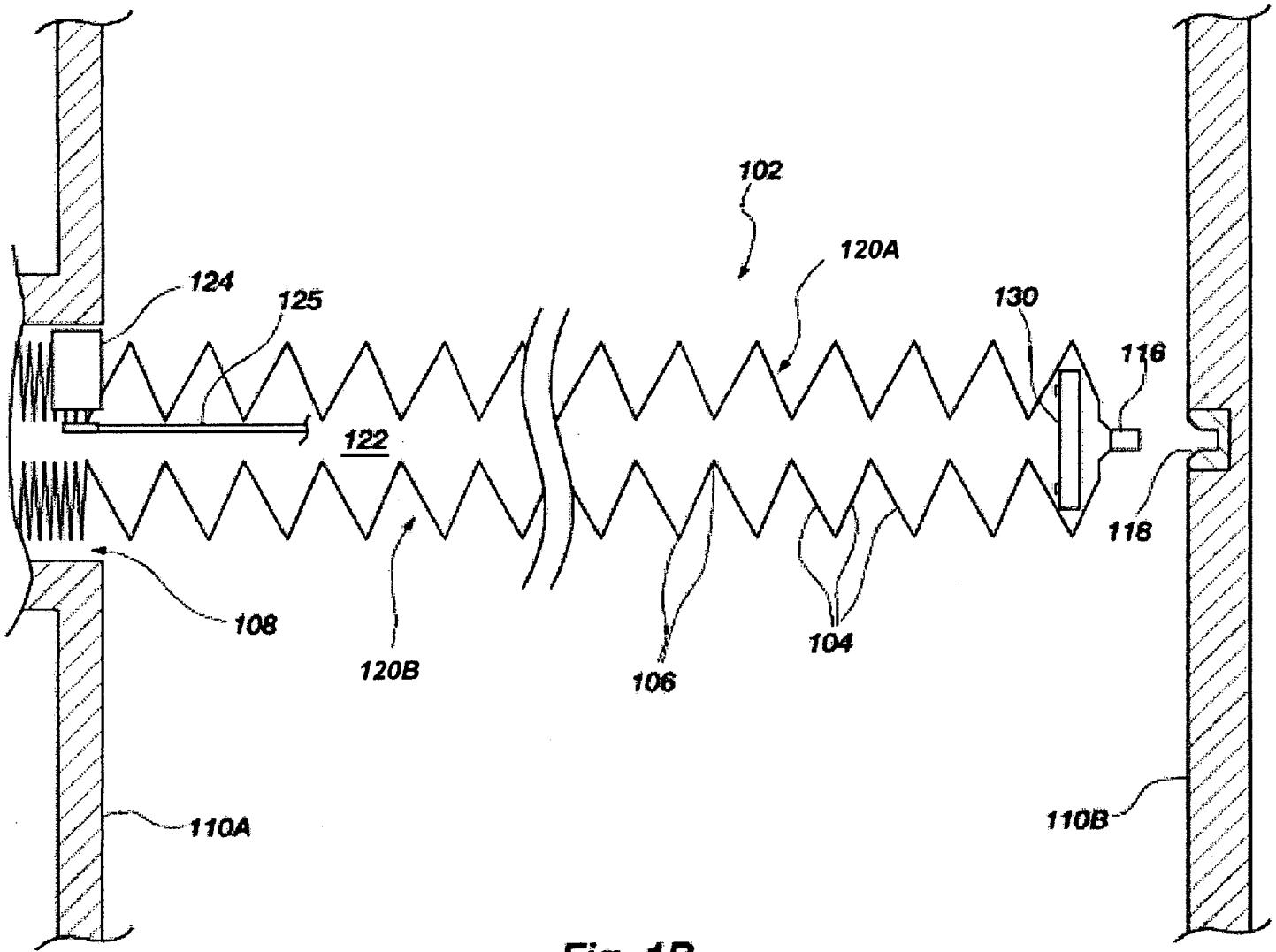
Figure 1C:
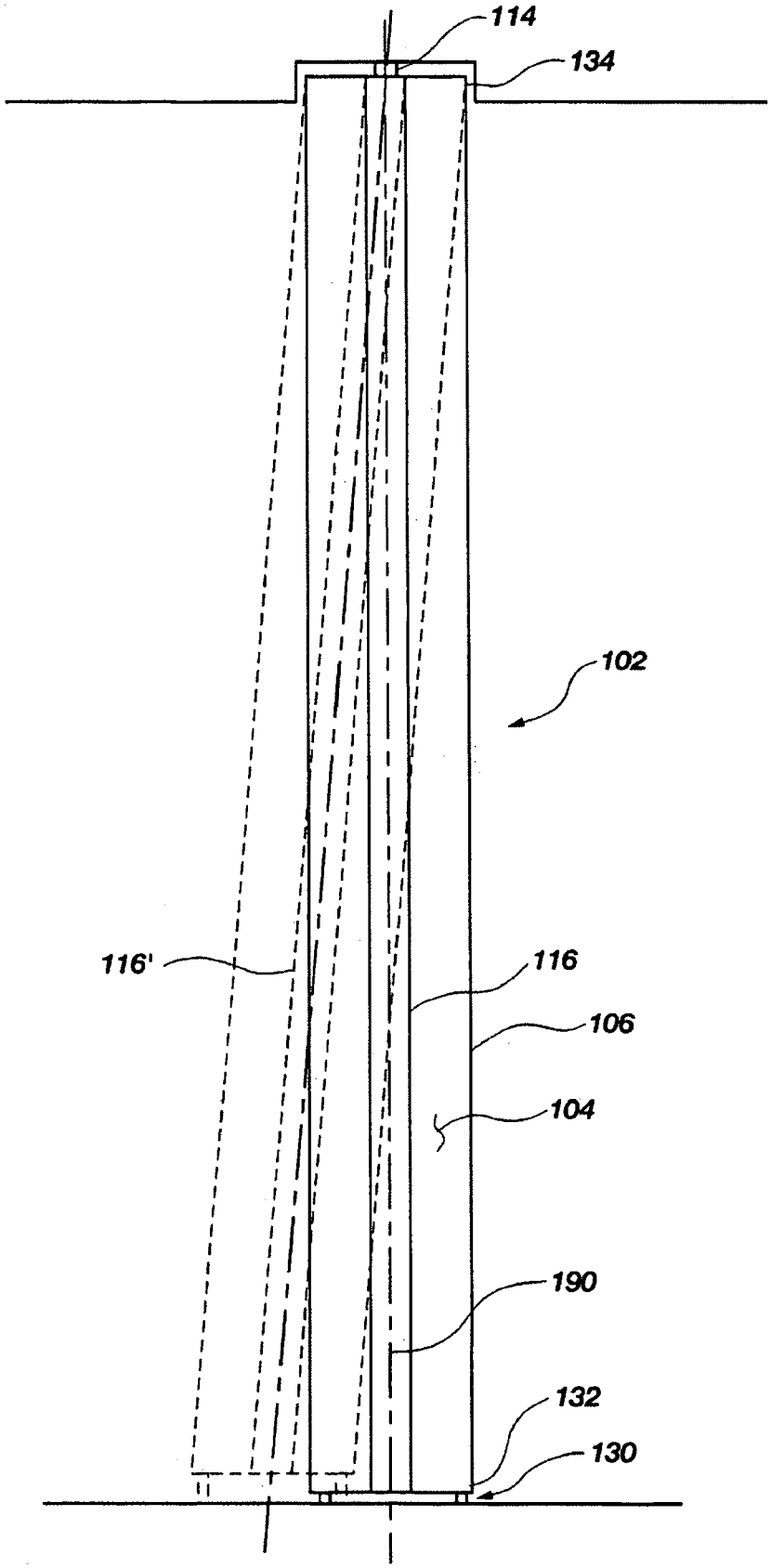

Referring to FIGS. 1A-1C, a system 100 is shown, which may also be referred to as an automatic door system, including a movable partition in the form of an accordion-type door 102. The door 102 may be used, for example, as a security and/or fire door. In other embodiments, the door 102 need not be utilized as a fire or security door, but may be used simply for the subdividing of a larger space into smaller rooms or areas. The door 102 may be formed with a plurality of panels 104 that are connected to one another with hinges or other hinge-like members 106. The hinged connection of the panels 104 enables the door 102 to be compactly stored or "stacked" in a pocket 108 formed in a wall 110A of a building when in a retracted or folded state.

When it is desired to deploy the door 102 to an extended position, for example, to secure an area such as an elevator lobby 112 during a fire, the door 102 is driven along a track 114 across the space to provide an appropriate barrier. When in a deployed or an extended state, a leading edge of the door 102, shown in the presently described embodiment as a male lead post 116, complementarily or matingly engages with a jamb or door post 118 that may be formed in a wall 110B of a building. As can be seen in FIG. 1B, an accordion-type door 102 may include a first accordion-style partition 120A and a second accordion-style partition 120B that is laterally spaced from the first partition 120A. Such a configuration may be utilized as a fire door wherein one partition 120A acts as a primary fire and smoke barrier, a space 122 between the two partitions 120A and 120B acts as an insulator or a buffer zone, and the second partition 120B acts as a secondary fire and smoke barrier. Such a configuration may also be useful in providing an acoustical barrier when the door 102 is used to subdivide a larger space into multiple, smaller rooms.

A drive, which may include, for example, a motor 124 and a drive belt or chain 125 (FIG. 1B), may be configured to open and close the door 102 upon actuation thereof. The automatic door system 100 may further include various sensors and switches to assist in the control of the door 102 through appropriate connection with the drive. For example, as shown in FIG. 1A, when used as a fire door, the door 102 may include a switch or actuator 126, commonly referred to as "panic hardware." Actuation of the switch or actuator 126 allows a person located on one side of the door 102 to cause the door to open if it is closed, or to stop while it is closing, allowing access through the barrier formed by the door for a predetermined amount of time. In one embodiment, the automatic door system 100 may further include, or may be associated with, an alarm system which, upon providing an appropriate signal, results in deployment or retraction of the door 102 depending on the specific situation.

It is noted that the drawings and description herein may refer to and illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal. Furthermore, the signal may be implemented as a physical connection between two elements or a wireless connection between two elements.

It is also noted that, while the exemplary embodiment shown and described with respect to FIGS. 1A and 1B is directed to a single accordion-type door 102, other movable partitions may be utilized. For example, a two-door, or bi-part door, system may be utilized wherein two similarly configured doors extend across a space and join together to form an appropriate barrier. Also, the present invention is applicable to movable partitions or barriers other than the accordion-type doors that are shown and described herein in example embodiments.

Referring still to FIGS. 1A-1C, the door 102 of the present invention may further include a directional control apparatus 130 that may be used to ensure vertical alignment of the door 102 or at least a portion thereof. For example, upon the exertion of an external force in a generally lateral direction, such as by a draft or from an individual pushing on the door 102 while it is being deployed or retracted, the lead post 116 (or some other section of the door 102) may deviate from its intended plumb, or substantially vertical, orientation as indicated by dashed lines at 116' in FIG. 1C. In other words, a lower portion of the door 102, such as a lower edge 132, may become laterally displaced relative to an upper edge 134 of the door 102, the upper edge 134 being substantially laterally fixed by virtue of its engagement with the track 114. As previously discussed, in such a case where the lead post 116 is substantially out of plumb (e.g., not substantially vertically oriented), the lead post 116 will not properly engage the jamb or door post 118 and will prevent the door 102 from properly closing and forming a proper barrier. However, in accordance with the present invention, the directional control apparatus 130 may be configured to correct a deviation of the door from its desired course or orientation, such as with respect to plumb.

It is noted that, while the present invention is generally discussed with respect to detecting that a section of a door 102 or other partition has deviated from a substantially plumb or vertical orientation and then correcting that deviation through use of a directional control apparatus 130, the present invention more broadly contemplates determining the current or actual orientation of a section of the door 102 relative to a reference orientation (e.g., a reference axis or reference plane) and actively positioning the section of the door to a selected or specified orientation relative to the reference orientation.

For example, an existing or previously installed door 102 may be retrofitted or modified to include a directional control apparatus 130. In certain installations, the door post 118, with which a lead post 116 is intended to engage, may have been improperly or carelessly installed such that it is out of plumb by a determined magnitude. In such a case, the directional control apparatus 130 may be configured to steer the lead post 116 of the door 102 such that it is also out of plumb by the same magnitude, and in a corresponding direction, thereby enabling the lead post 116 to engage with the door post 118 and effect a desired coupling or seal therebetween. In short, the present invention may include detecting the actual orientation of a section of the door 102 relative to plumb (or any other specified reference orientation) and, if necessary, reposition the section of the door 102 so that it is at a specified orientation relative to the reference orientation (e.g., plumb).

Figure 2A:
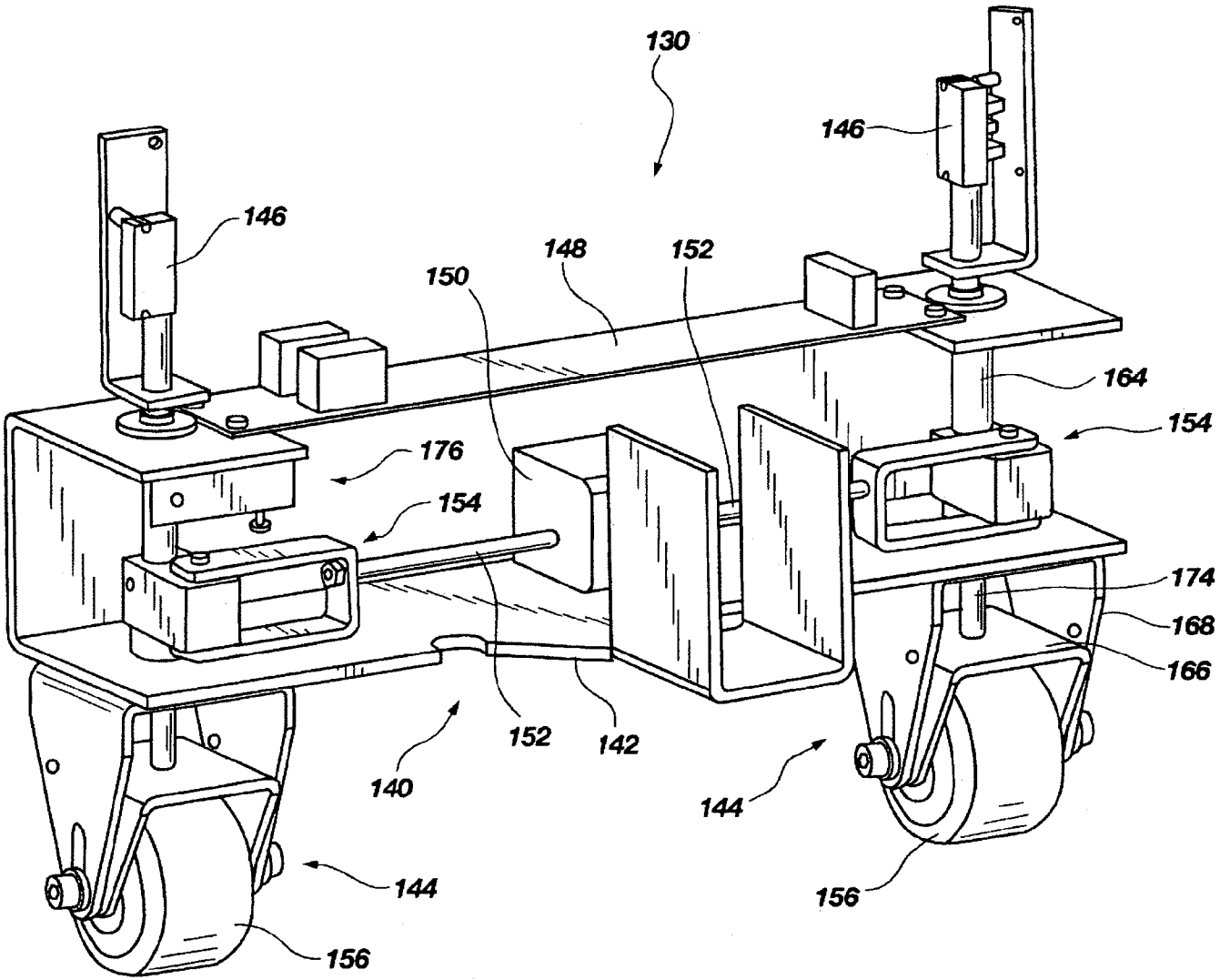
FIGS. 2A and 2B show perspective views of an apparatus for directionally controlling a movable partition in accordance with an embodiment of the present invention.
Figure 2B:
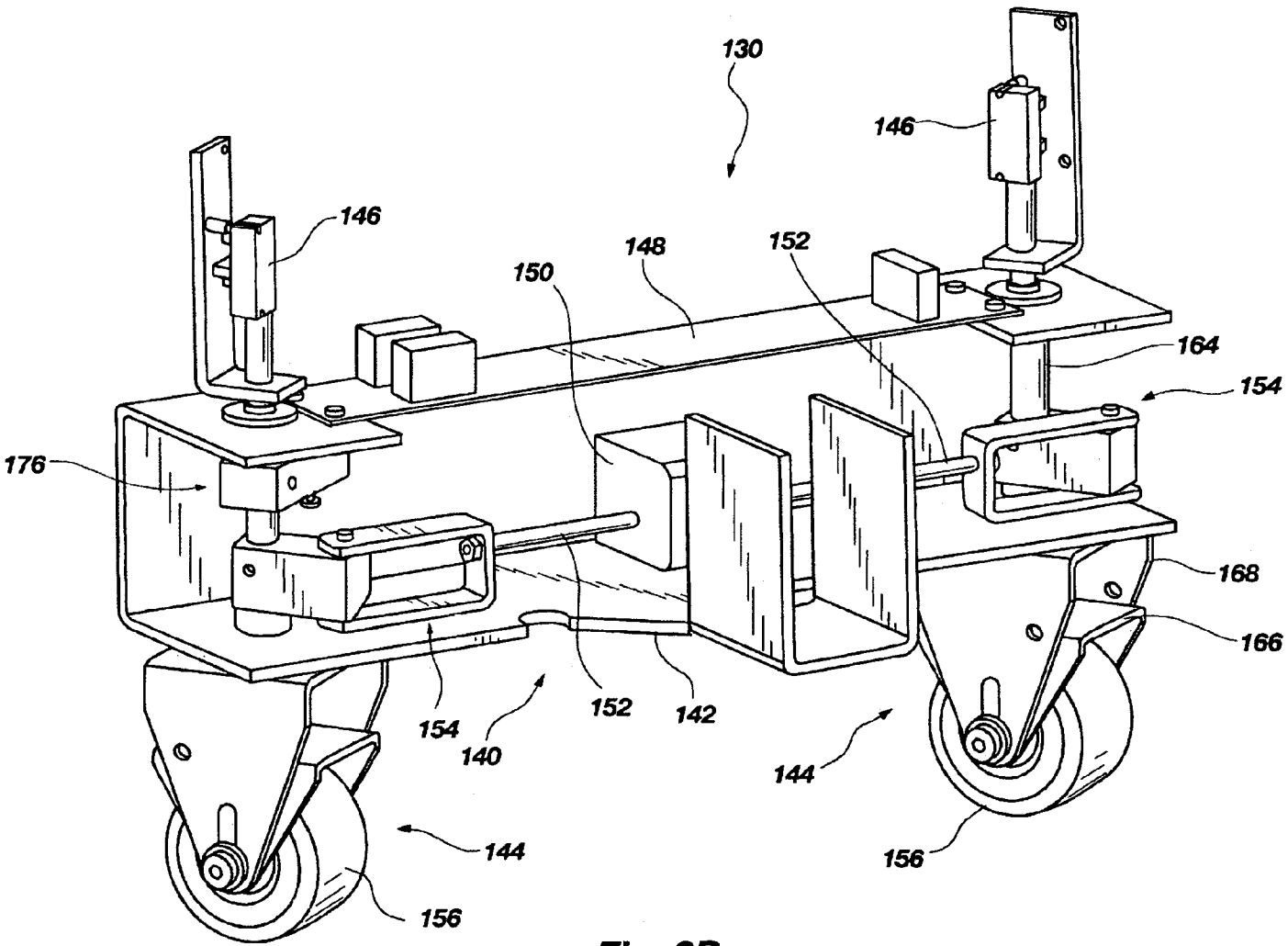

Referring now to FIGS. 2A and 2B, an example of a directional control apparatus 130 in accordance with one embodiment of the invention includes a trolley 140 comprising a frame member 142 and one or more steerable roller assemblies 144 coupled therewith. The frame member 142 may also be configured to be coupled with a section of the door 102 (FIGS. 1A-1C), such as, for example, adjacent the lead post 116. One or more sensors 146 may be used to determine whether the door 102 (FIGS. 1A-1C), or at least the section in which the directional control apparatus 130 is disposed, is out of plumb. The sensors 146 may be operatively coupled to and in communication with a control module 148 that provides instructions to and controls a steering actuator 150. The steering actuator 150 may be mechanically coupled with the roller assemblies 144 through linkage components including, for example, drive rods 152 and pivot assemblies 154. In another embodiment, the steering actuator 150 may be more directly coupled to a roller assembly 144 such as through appropriate gearing or other appropriate mechanical couplings. The steering actuator 150 may include, for example, a linear positioning stepper motor configured to displace the drive rods 152 in a substantially linear direction. Of course, other actuators and drive assemblies may be utilized as will be appreciated by those of ordinary skill in the art.

Figure 3:
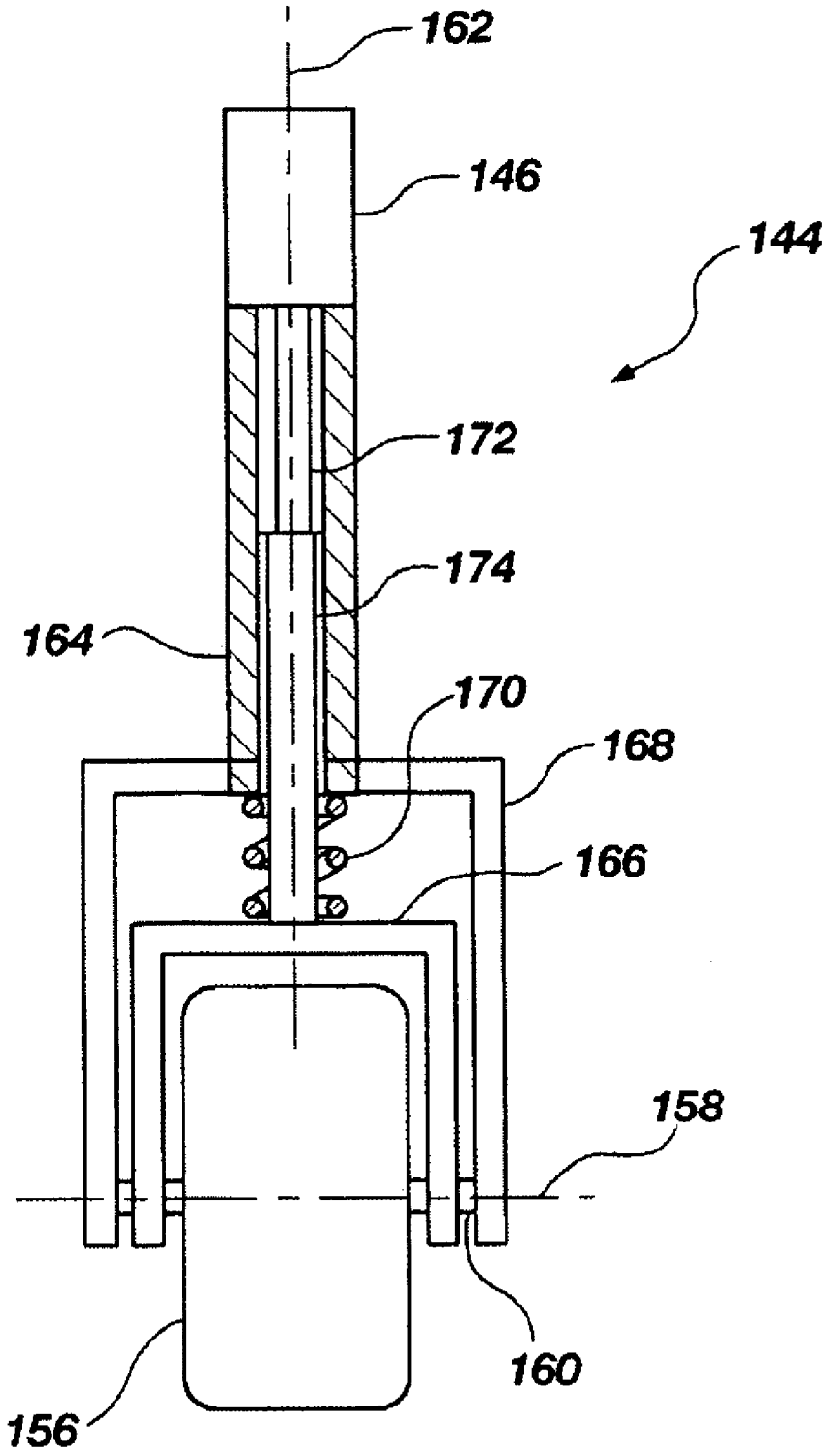
FIG. 3 shows a partial cross-sectional view of a roller assembly used in conjunction with the apparatus shown in FIGS. 2A and 2B in accordance with an embodiment of the present invention.

Referring briefly to FIG. 3 in conjunction with FIGS. 2A and 2B, a roller assembly 144 is shown in partial cross-sectional view in accordance with one embodiment of the present invention. Each roller assembly 144 may include a rolling member, such as a wheel 156, configured to rotate or roll about a first axis 158, referred to herein as a rolling axis, and which may be defined by a shaft 160. The roller assembly 144 is further configured to rotate or be steered about a second axis 162, referred to herein as a steering axis, and which may be defined by a steering shaft 164. Inner and outer support members 166 and 168 may be used to support the wheel 156 in relationship to the frame member 142 while enabling a portion of the roller assembly 144, including the wheel 156, to be displaced in a direction generally along the second axis 162 relative to the frame member 142. A biasing member 170, such as a spring, may be disposed between the inner and outer support members 166 and 168 to bias the wheel 156 away from the frame member 142 so as to ensure that the wheel 156 maintains contact with the floor or other surface.

As also shown in FIG. 3, one or more sensors 146 may be coupled to the roller assembly 144 in determining whether a door 102 (FIGS. 1A-1C) is plumb or out of plumb. For example, the sensor 146 may include a linear potentiometer having a component 172 that engages an inner shaft 174 (also referred to herein as the inner steering shaft) coupled to the inner support member 166. As the wheel 156 and inner support member 166 are displaced along the second axis 162 relative to the frame member 142 (FIGS. 2A and 2B) and the outer support member 168, such relative displacement is detected by the linear potentiometer. The linear potentiometer then produces a voltage signal that is representative of both the magnitude and the direction of such relative displacement. It is noted that other types of sensors may be utilized to help determine whether a door 102 is plumb or out of plumb and, if out of plumb, the magnitude of deviation from an in-plumb state. For example, the sensor 146 may include an optical or magnetic encoder, a tilt sensor or switch, a linear variable differential transformer, a laser switch, a Hall effect transducer, a gyroscopic transducer, or an ultrasonic transducer.

Referring back to FIGS. 2A and 2B, the directional control apparatus 130 may further include an alignment assembly 176 associated with a roller assembly 144 and configured to automatically align the roller assembly 144 when the directional control apparatus 130 is initiated or at other desired times. For example, referring to FIGS. 4A and 4B, an exemplary alignment assembly 176 may include one or more sensors 178A and 178B, such as proximity sensors, and an alignment indicator 180 that is coupled to the steering shaft 164. The sensors 178A and 178B may thus determine when the alignment indicator 180 is at a predetermined location representing a desired orientation of the roller assembly 144. In one embodiment, the sensors 178A and 178B may include a magnetic-type proximity sensor configured to detect the presence of a ferromagnetic object. In such an embodiment, the alignment indicator 180 may be formed of a ferromagnetic material and configured to define slots 182A and 182B. The sensors 178A and 178B are then disposed so as to be locationally above (when in an intended operating orientation) the radial pathway of an associated slot 182A and 182B. As the alignment indicator 180 rotates with the steering shaft 164 of the roller assembly 144, the sensors 178A and 178B detect the presence or absence of any ferromagnetic material. Thus, if the alignment indicator 180 is positioned such that the sensors 178A and 178B are immediately adjacent the slots 182A and 182B, such as shown in FIG. 4B, the sensors 178A and 178B will appropriately indicate the lack of ferromagnetic material. However, if the alignment indicator 180 is oriented such that one of the sensors 178A and 178B is positioned above and adjacent a portion of the ferromagnetic material of the alignment indicator 180, such as is shown in FIG. 4C, the sensor 178A will indicate the presence of such ferromagnetic material.

Figure 4A:
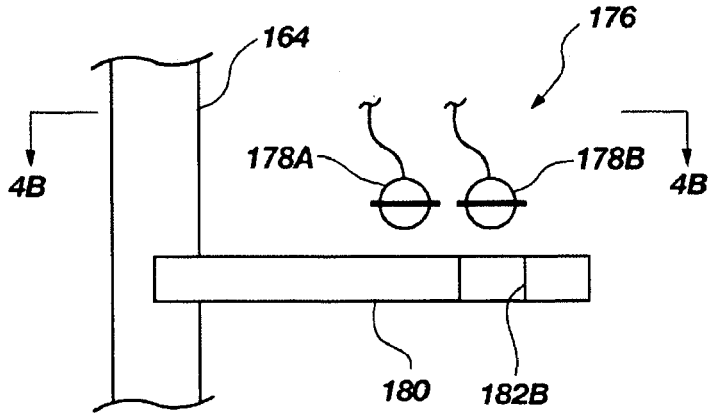
FIGS. 4A-4C show an alignment apparatus used in conjunction with the apparatus shown in FIGS. 2A and 2B according to an embodiment of the present invention.
Figure 4B:
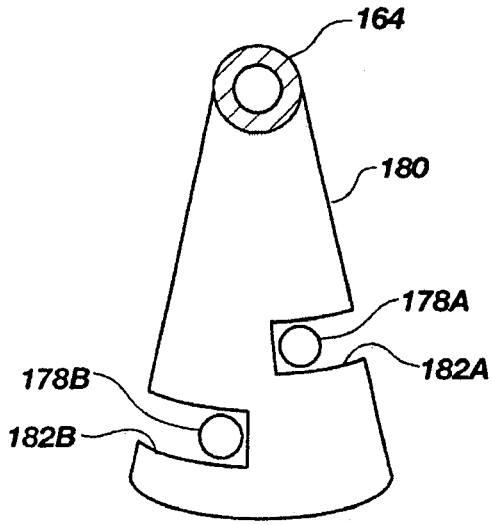
Figure 4C:
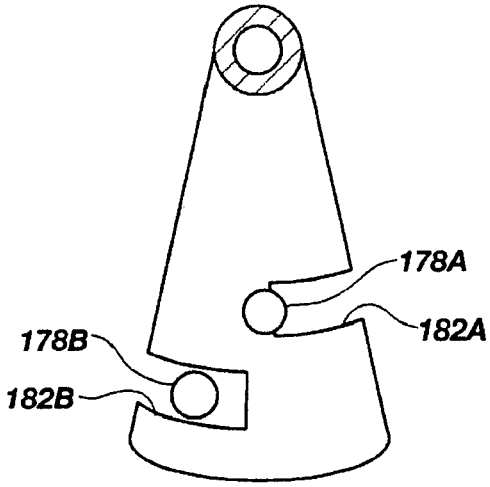

In aligning the roller assemblies 144 using the embodiment shown and described with respect to FIGS. 4A-4C, if one of the sensors 178A detects the presence of a ferromagnetic material (such as shown in FIG. 4C), an appropriate signal will be sent to the control module 148 (FIGS. 2A and 2B) to actuate the steering actuator 150 to effect rotation of the roller assembly 144 about the second axis 162 in a desired direction. Similarly, if the other sensor 178B indicates the detection of a ferromagnetic material, the control module 148 and steering actuator 150 will effect rotation of the roller assembly 144 in the opposite direction. When both sensors 178A and 178B indicate a lack of presence of ferromagnetic material (such as shown in FIGS. 4A and 4B), the control module 148 will recognize that the roller assembly 144 is appropriately aligned.

In one embodiment, the sensors 178A and 178B may include a MAGNASPHERE® ferrous proximity switch available from Magnasphere Corporation of Brookfield, Wis. The alignment indicator may be formed of a material comprising steel or another ferrous metal or metal alloy. Of course, it will be appreciated by those of ordinary skill in the art that other components may be used for the sensors 178A and 178B and/or alignment indicator 180 in practicing the described embodiment. Additionally, other alignment assemblies or mechanisms may be used for initial and/or periodic alignment of the roller assemblies 144.

Figure 5A:
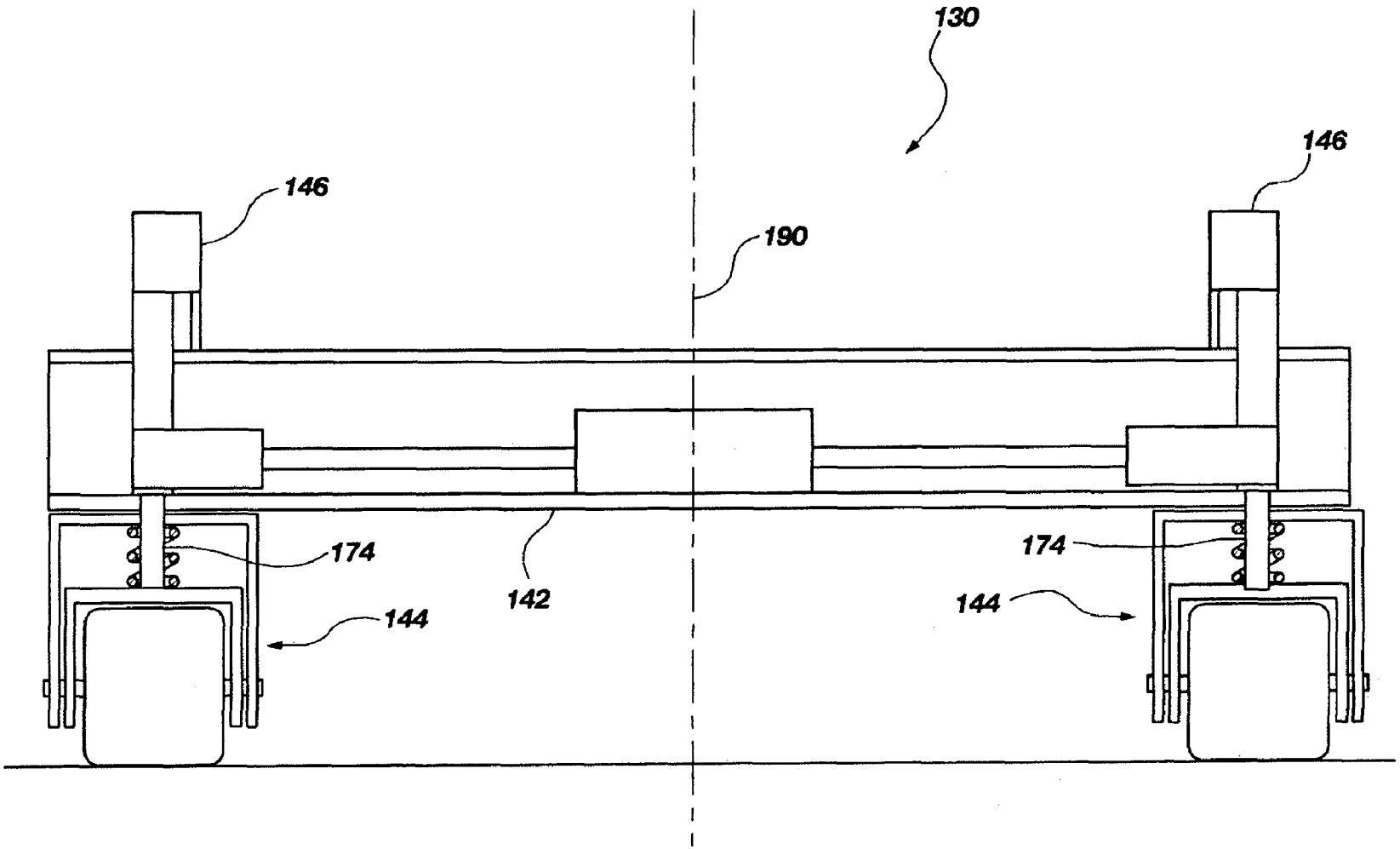
FIGS. 5A and 5B show elevational views of the apparatus of FIGS. 2A and 2B at various stages of operation in accordance with an embodiment of the present invention.

Referring to FIGS. 1A-1C, 2A, 2B, 3, 5A and 5B, operation of the directional control apparatus 130 is now described. As indicated above, upon initialization or powering up of the directional control apparatus 130, the roller assemblies 144 are aligned to a predetermined orientation relative to the frame member 142. As the door 102 is being deployed, roller assemblies 144 maintain their initial orientation until the door 102 is sensed to be out of plumb. In one embodiment, the door 102, or a portion thereof, is determined to be out of plumb by monitoring the displacement of the inner steering shafts 174 relative to the frame member 142 using linear potentiometers as sensors 146. Thus, if the door 102 or, more particularly, the section of the door 102 being monitored such as the lead post 116, is substantially plumb as indicated in FIG. 5A, the linear potentiometers (sensors 146) may generate voltage signals which are similar to one another. For example, in one embodiment, if the section of the door 102 located above the directional control apparatus 130 is plumb, each sensor 146 will generate a signal of approximately 2.5 volts.

Figure 5B:
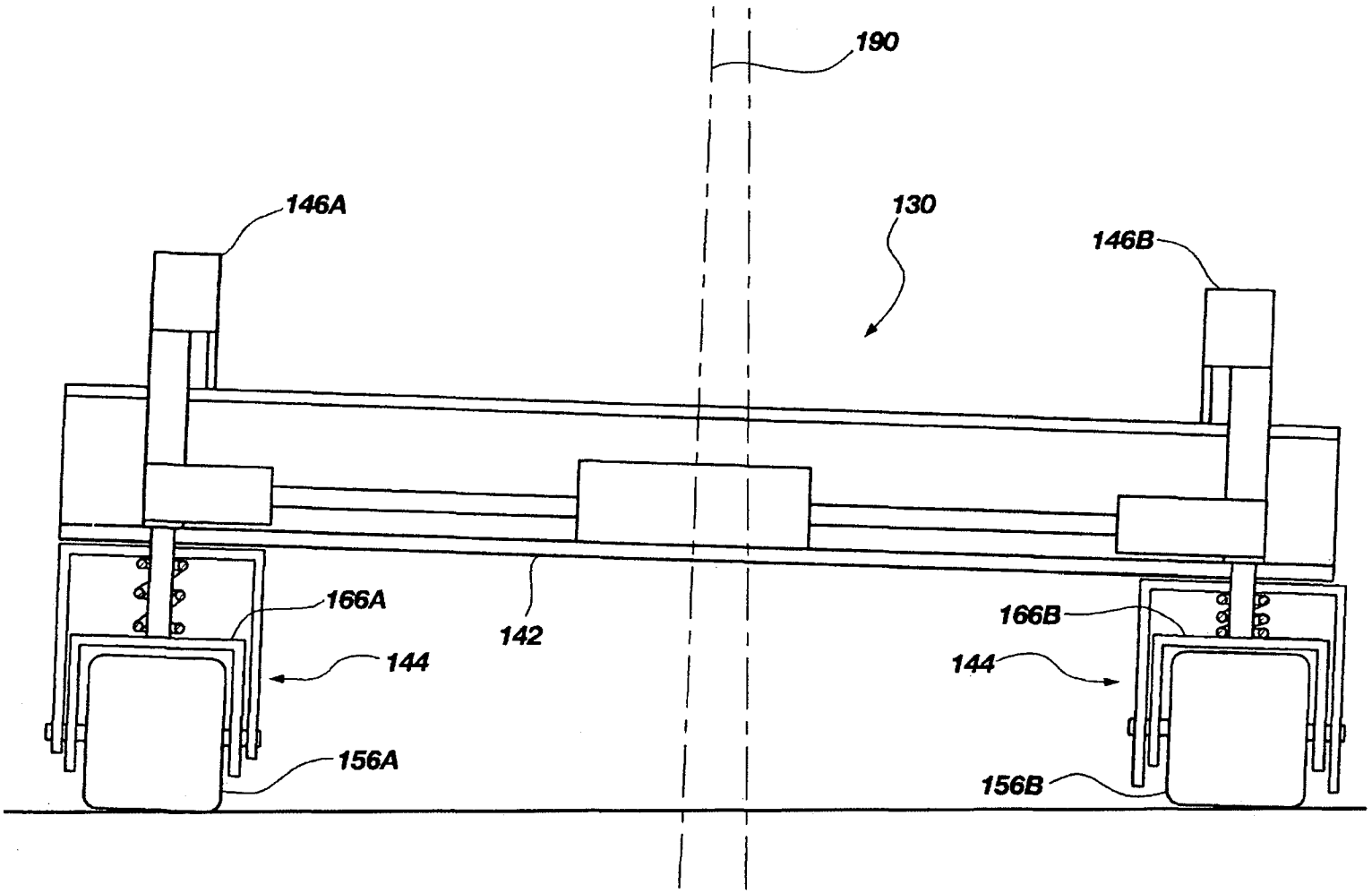

If the section of the door 102 positioned above the directional control apparatus 130 becomes out of plumb, because of the geometric arrangement of the roller assemblies 144 relative to the centerline 190 of the door 102, various portions of the roller assemblies 144, including the inner steering shafts 174 will become displaced relative to the frame member 142, thereby causing the sensors 146 to generate new signals. Thus, for example, one wheel 156A and associated inner support member 166A may become generally displaced away from the frame member 142 while the other wheel 156B and associated inner support member 166B may become displaced generally toward the frame member 142 as shown in FIG. 5B. In such an instance, a first sensor 146A may generate a signal that is less than 2.5 volts while a second sensor 146B may generate a signal which is greater than 2.5 volts (or vice versa). The control module 148 then attempts to rectify the difference in voltage signals produced by the sensors 178A, 178B by activating the steering actuator 150 to turn the roller assemblies 144 in the appropriate direction such as is indicated in FIG. 2B, for example. As the sensors 146 provide new signals to the control module 148, the roller assemblies 144 may be further adjusted. When the sensors 146 generate voltage signals that are substantially equivalent, the control module 148 may direct the steering actuator to turn the roller assemblies 144 back to their original orientation so that the door 102 may continue along its intended course.

It is noted that if the door 102 becomes out of plumb in the direction that is opposite to that indicated in FIG. 5B, that a similar process will occur but with the roller assemblies being turned in the opposite direction so as to steer the door 102 back into a plumb orientation. Furthermore, the control module 148 may be configured to note the direction in which the door 102 is traveling (i.e., opening or closing) and to factor this information into the determination of which way to turn the roller assemblies 144 in correcting a vertical deviation of the door 102. Additionally, it is contemplated that the position of the door 102 may be considered by the control module 148 such that, for example, if the door 102 is intended to travel through a curved path, the roller assemblies 144 assist in the door 102 turning and traversing such a path while also maintaining the plumb orientation of the door 102.

Figure 6:
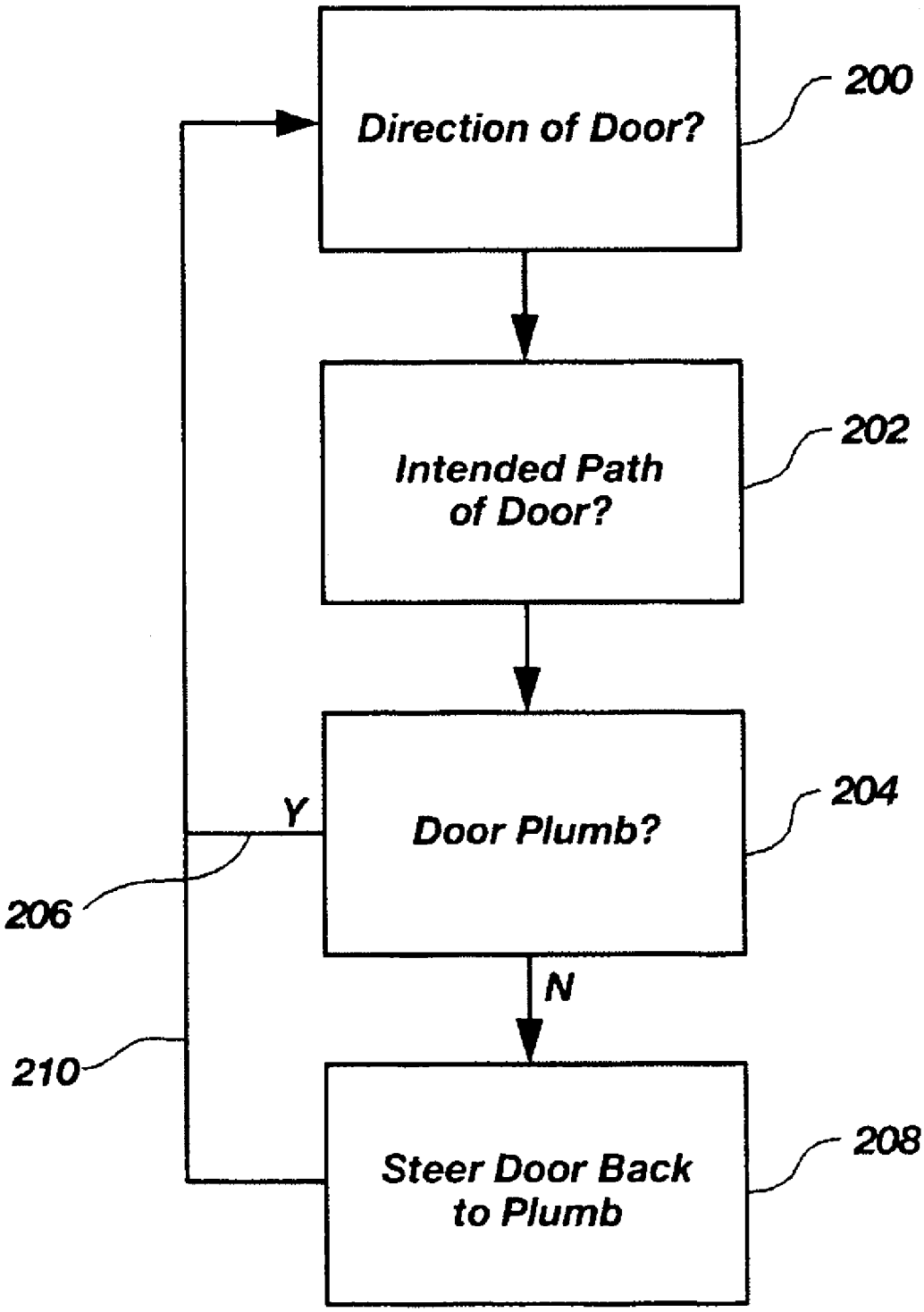
FIG. 6 is a flow chart depicting a method of controlling a movable partition in accordance with one embodiment of the present invention.

Thus, referring to FIG. 6, a method of operating a door 102 (FIG. 1) or other movable partition may include determining the direction of the door 102 (i.e., forward or reverse) as indicated at 200, and determining the intended pathway of the door 102 (e.g., whether the intended pathway is straight or curved) as indicated at 202. The method further includes determining whether the door 102, or a section thereof, is substantially plumb as indicated at 204. If the door 102, or section thereof, is plumb, the monitoring process continues as indicated at 206. If the door 102, or section thereof, is out of plumb, the door 102 may be steered or otherwise manipulated back to a plumb orientation without the need to stop or otherwise interrupt the operation of the door 102 as indicated at 208. The process then continues as indicated at 210.

Referring briefly to FIGS. 1A-1C, 2A and 2B, in another method, the directional control apparatus 130 need not be used for correcting out of plumb orientations of the door 102 or other movable partition. Rather, the directional control apparatus 130 may be used to assist in steering the movable partition through a curve or bend of a defined pathway. Thus, for example, the location of a particular section (such as the lead post 116) of the door 102 along the defined pathway may be determined. In one embodiment, an optical encoder may be utilized in conjunction with the drive of the door to determine the location of the leading edge of the door 102 (or some other section) along the defined pathway. As a particular section of the door 102 traverses the bend in the pathway, the directional control apparatus 130 may selectively steer that section, or more particularly the lower edge of the movable partition associated with the section, through the curve or bend in the pathway.

Figure 7A:
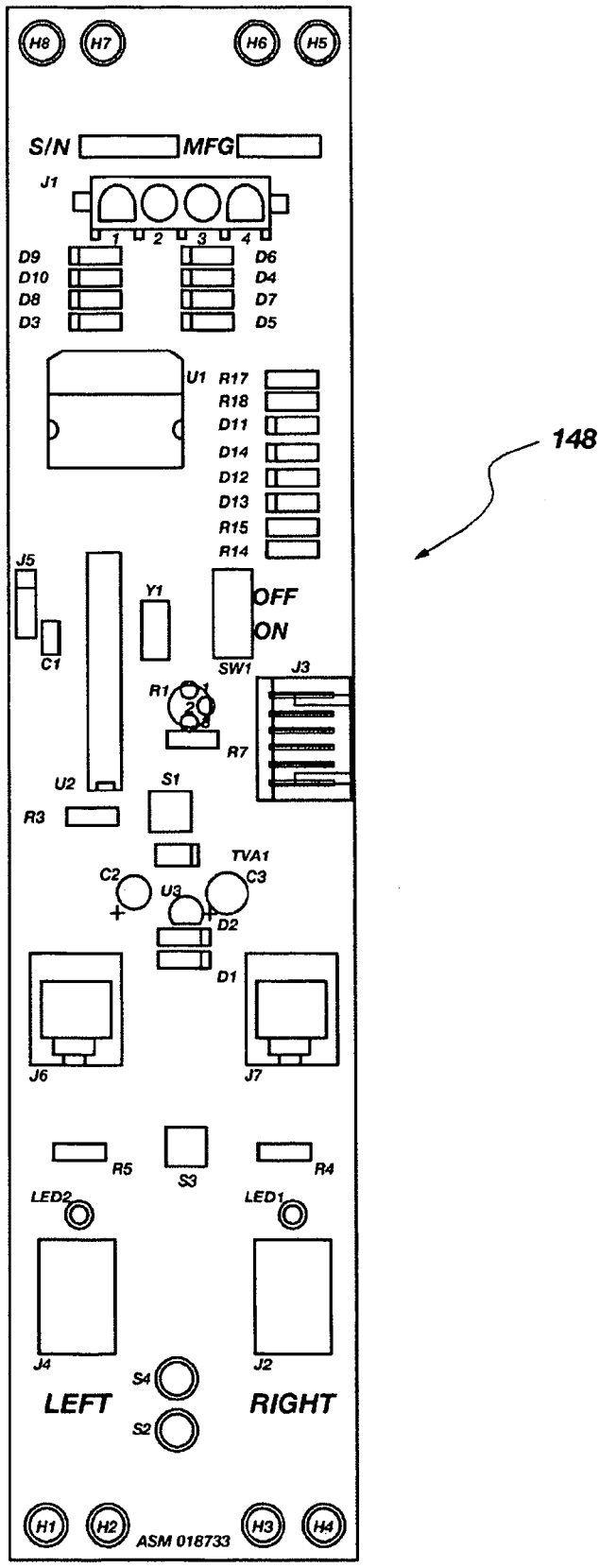
FIGS. 7A and 7B show an exemplary control module and control schematic that may be employed with the apparatus of FIGS. 3A-3C.
Figure 7B:
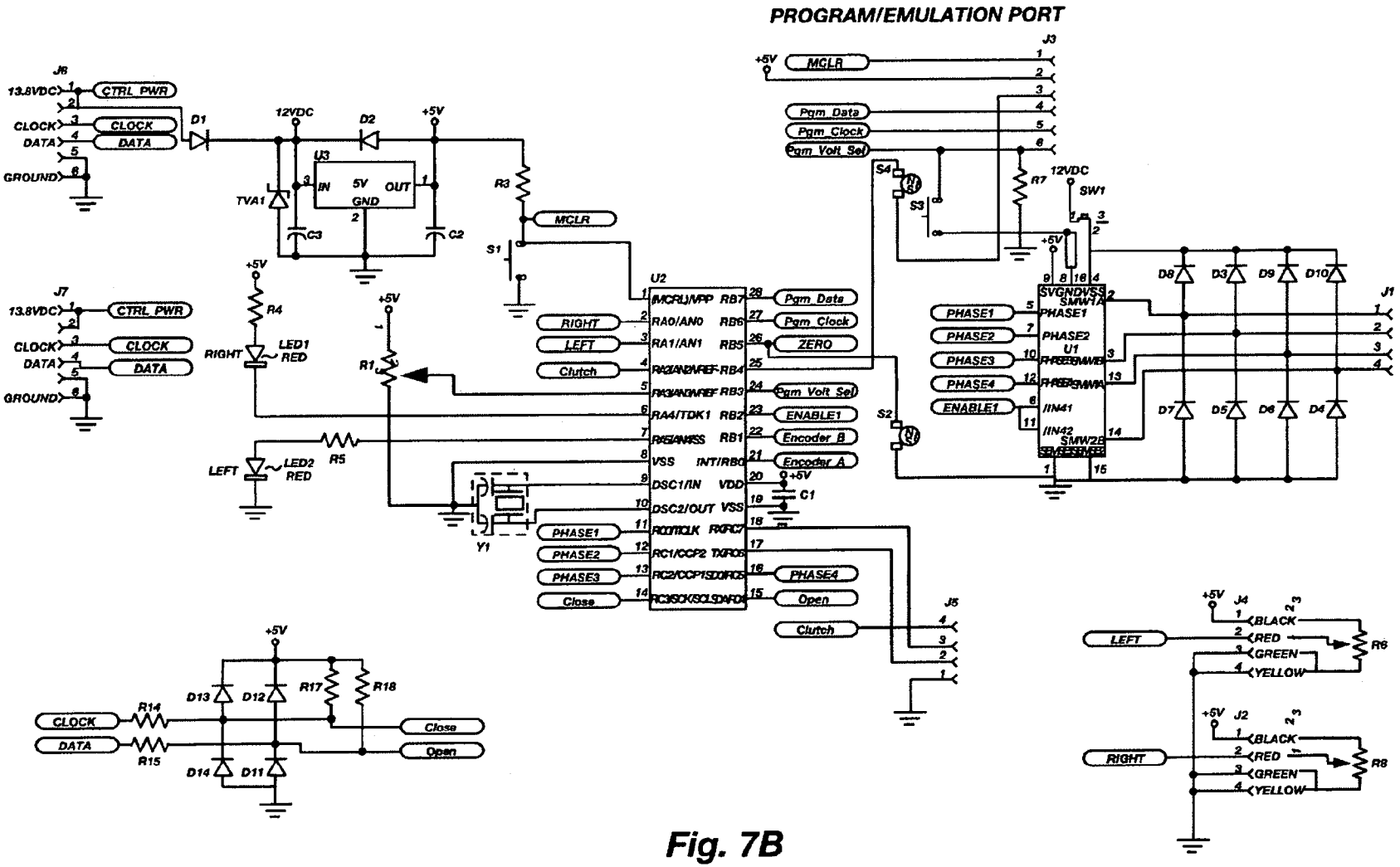

Referring now to FIG. 7A, a control module 148 according to one embodiment is shown as a printed circuit board while an associated electrical schematic is shown in FIG. 7B. Such a control module 148 and associated electrical scheme may be used in conjunction with the control of the above-described directional control apparatus 130 and in carrying out the above-described method of controlling a door 102 or other movable partition. However, as will be appreciated by those of ordinary skill in the art, various control schemes and hardware, software or combined hardware and software implementations may be used in practicing the present invention. It is noted that the exemplary control module 148 or other component of the directional control apparatus 130 may be in communication with a system controller (not shown). Such a controller may include, for example, a processing unit, memory devices, input and output devices and be configured to monitor the state of the door 102 (e.g., position along a defined path, opening, closing, plumb, out of plumb, etc), monitor other aspects related to the control of the door 102 (e.g., whether a triggering event such as actuation of an alarm has occurred), and thereby operate the door 102 under a defined set of parameters or rules.

Figure 8A:
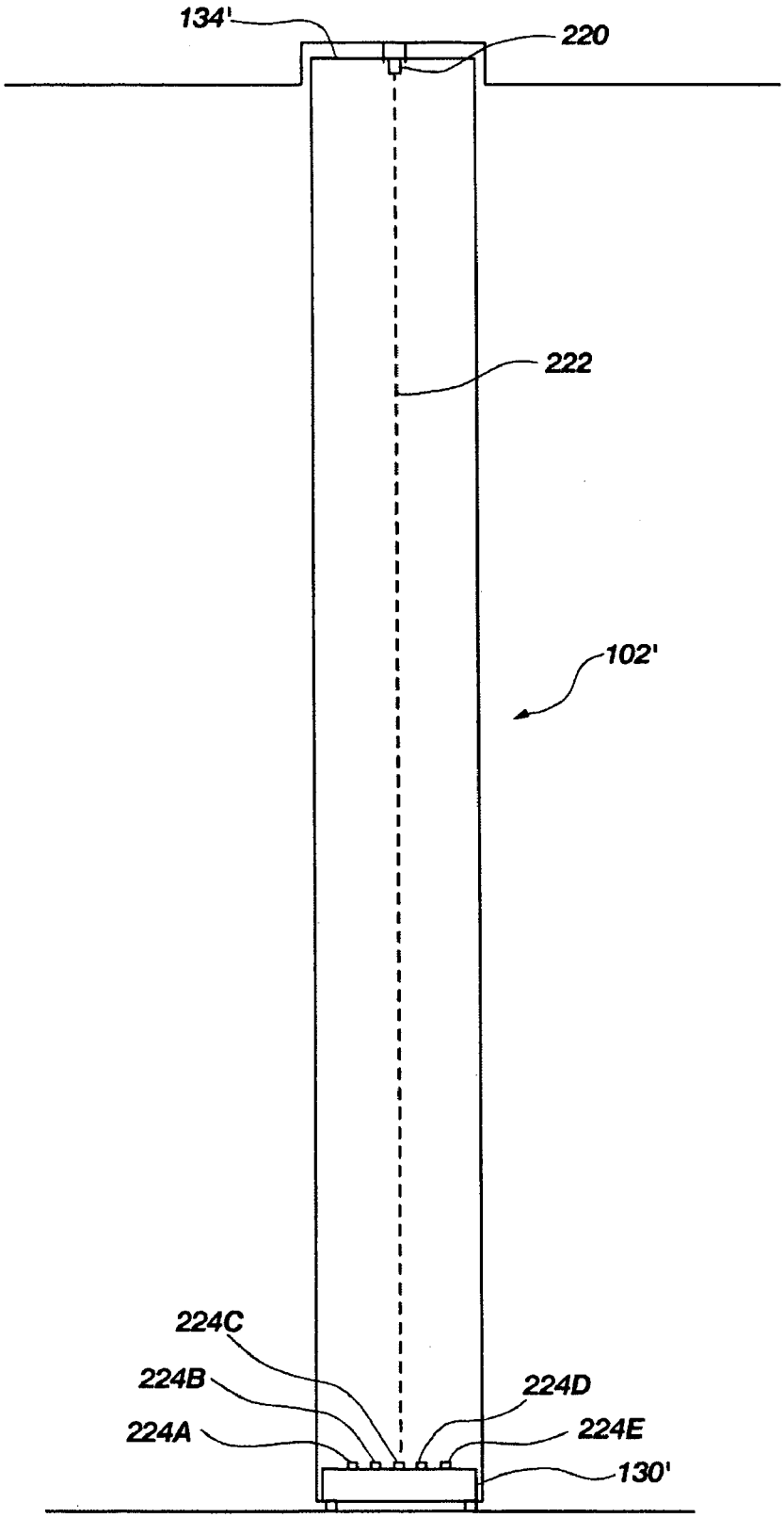
FIGS. 8A and 8B show schematic views of another apparatus for directionally controlling a movable partition in accordance with an embodiment of the present invention.
Figure 8B:
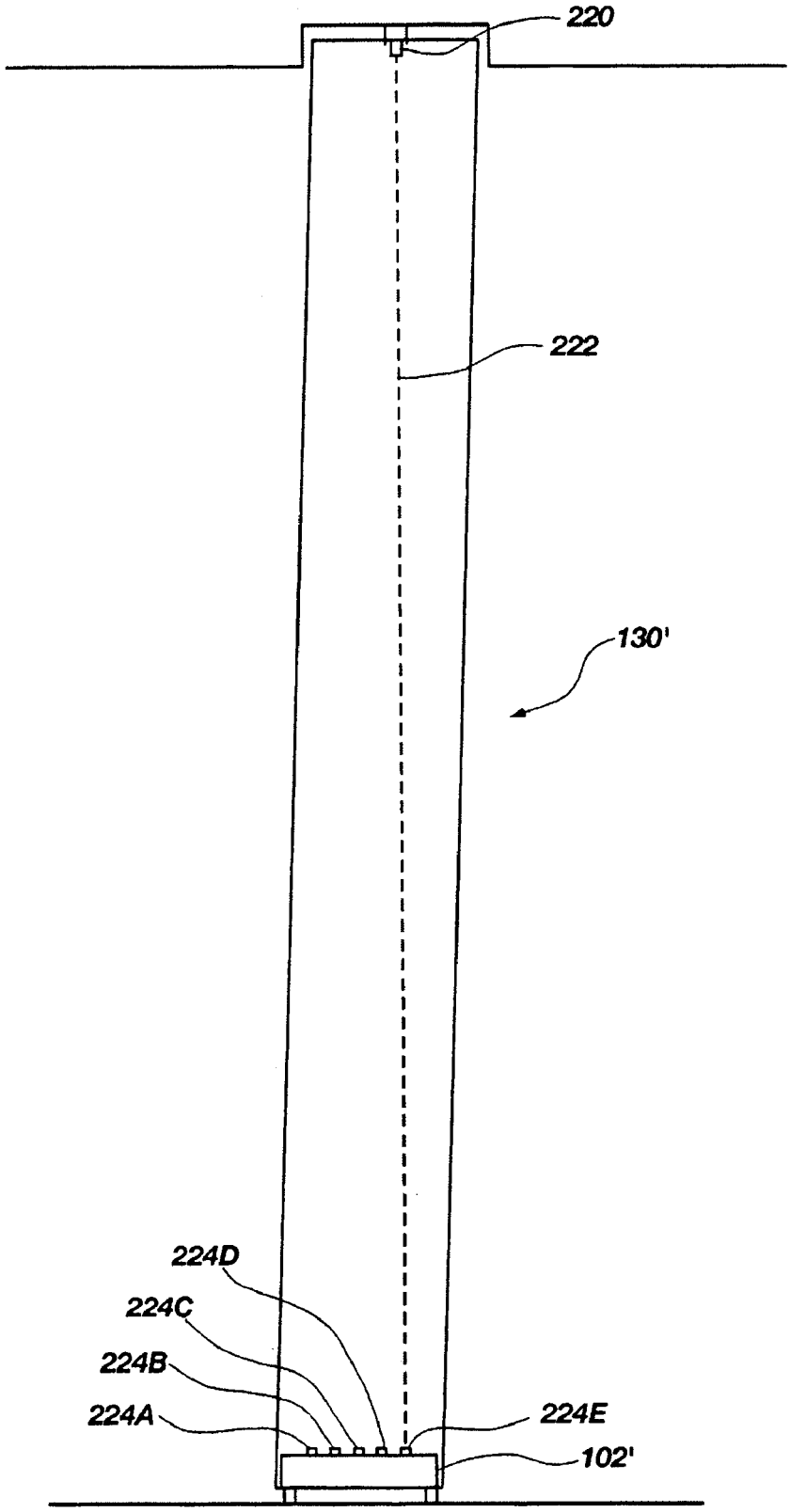

Referring now to FIGS. 8A and 8B, a schematic view of a movable partition, such as a door 102', in accordance with another embodiment of the present invention is shown. A signal transmitter 220 transmits a discrete signal 222, such as a laser beam, from a laterally fixed location adjacent the upper edge 134' of door 102'. The discrete signal 222 is detected by one or more of a plurality of discrete signal detectors or sensors 224A-224E such as, for example, photodiodes. The sensors 224A-224E may be substantially symmetrically laterally disposed with respect to the vertical centerline of the door 102' (i.e., when the door 102' is plumb). In operation, the detection of the discrete signal 222 by one of the sensors 224A-224E determines whether or not the door 102' is plumb. Thus, for example, the detection of the discrete signal 222 by the center sensor 224C, as shown in FIG. 8A, may indicate that the door 102', or the section where the directional control apparatus 130' is located, is plumb. On the other hand, detection of the discrete signal 222 (which remains plumb regardless of the orientation of the door 102') by an off-center sensor such as, for example, sensor 224E, may indicate that the door 102' is out of plumb. The directional control apparatus 130' may then appropriately return the door 102' to a substantially plumb orientation or state in a manner as described above.

It is noted that, while the exemplary embodiments described hereinabove include a pair of roller/steering elements (e.g., roller assemblies 144 and/or wheels 156), the present invention may be practiced with a single roller/steering element if so desired. However, it is also noted that in some embodiments, an arrangement using multiple roller/steering elements that are spaced about, or substantially symmetrically located relative to, the vertical centerline of the door 102, 102' (e.g., centerline 190 of FIGS. 5A and 5B) provides additional lateral support to the door 102, 102' such that a draft or application of a force to the door 102, 102' is less likely to cause the door 102, 102' to become out of plumb. For example, it has been determined that the embodiment shown and described with respect to FIGS. 2A, 2B and 3 provides improved lateral support such that an associated door 102 remained substantially plumb until a force of at least 40 pounds (lbs.) is applied at a location adjacent the lead post 116 (FIG. 1A) and approximately midway between the lower and upper edges 132 and 134 thereof.

Figure 9:
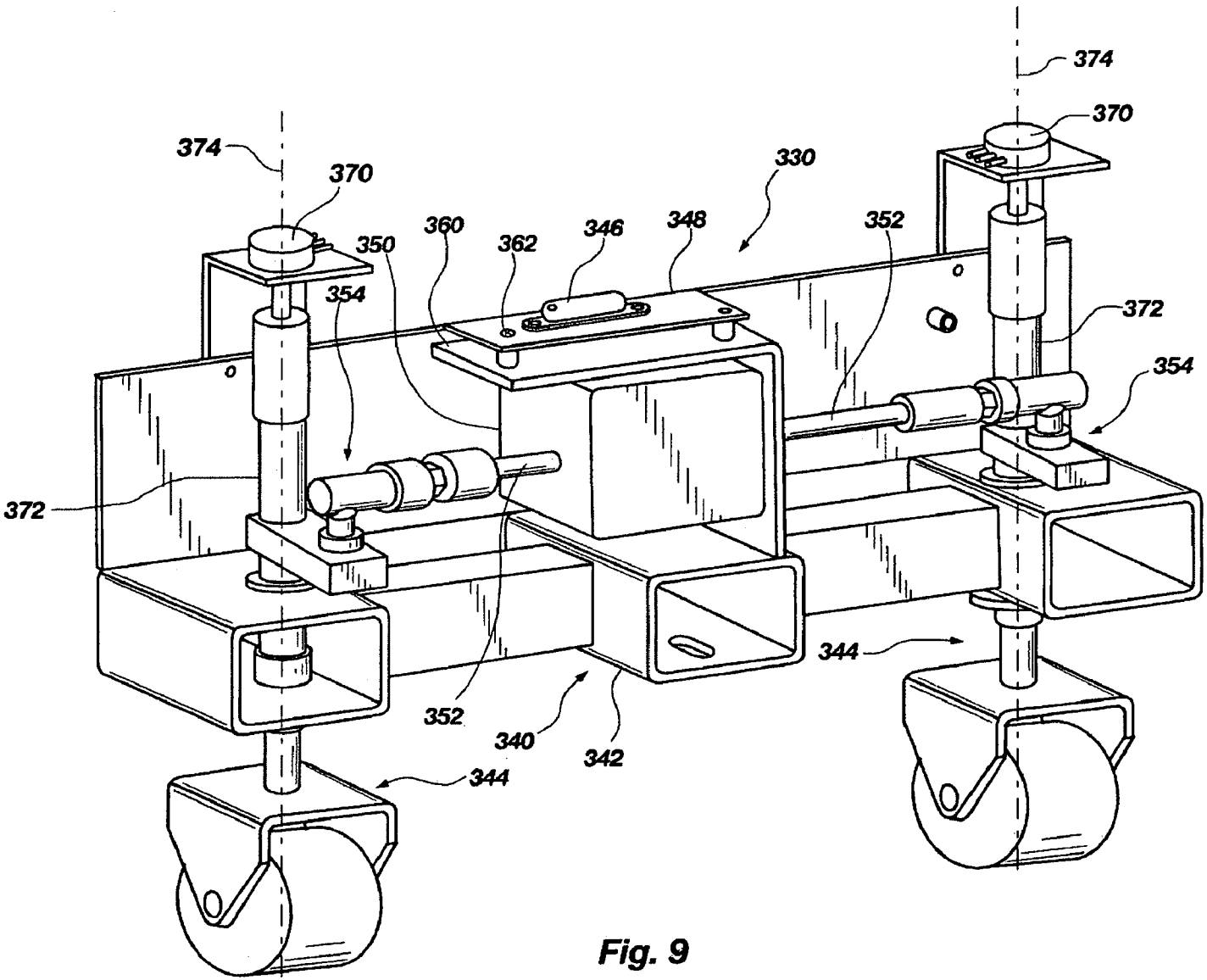
FIG. 9 is a perspective view of an apparatus for directionally controlling a movable partition in accordance with yet another embodiment of the present invention.
Figure 10:
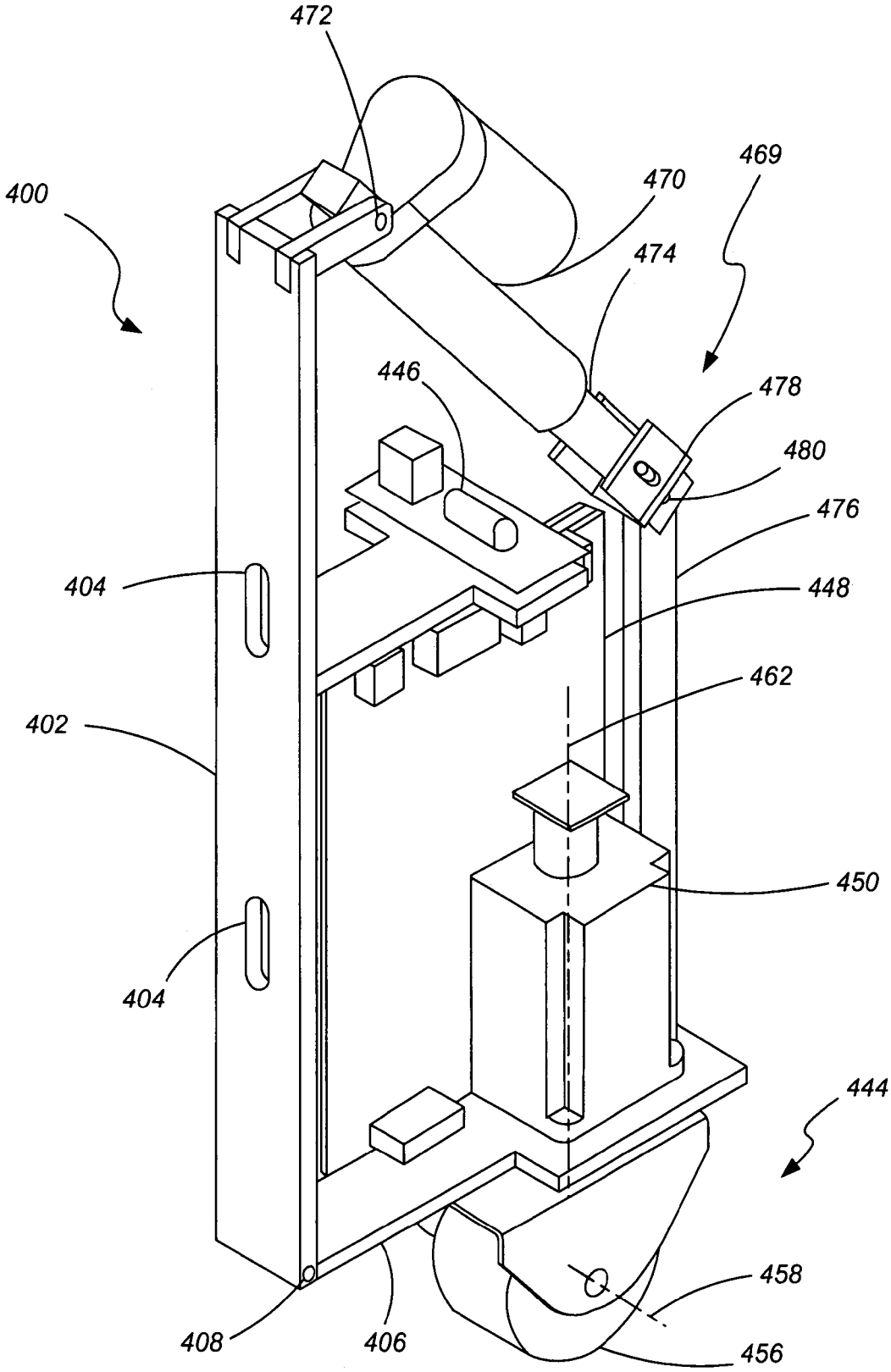
FIG. 10 is a perspective view of an apparatus for controlling the displacement of a moveable partition in accordance another embodiment of the present invention.

Referring now to FIG. 9, another embodiment of a directional control apparatus 330 includes a trolley 340 comprising a frame member 342 and one or more steerable roller assemblies 344 coupled therewith. The frame member 342 may also be configured to be coupled with a section of the door 102 (FIGS. 1A-1C), such as, for example, adjacent the lead post 116. One or more sensors 346 may be used to determine whether the door 102 (FIGS. 1A-1C), or at least the section in which the directional control apparatus 330 is disposed, is out of plumb. The sensor 346 may be operatively coupled to and in communication with a control module 348 that provides instructions to and controls a steering actuator 350. The steering actuator 350 may be mechanically coupled with the roller assemblies 344 through linkage components including, for example, drive rods 352 and ball and socket assemblies 354. In another embodiment, the steering actuator 350 may be more directly coupled to a roller assembly 344 such as through appropriate gearing or other appropriate mechanical couplings. The steering actuator 350 may include, for example, a linear positioning stepper motor configured to displace the drive rods 352 in a substantially linear direction. Of course, other actuators and drive assemblies may be utilized as will be appreciated by those of ordinary skill in the art.

In one exemplary embodiment, the sensor 346 may include a tilt sensor, such as an MCL NARROW ANGLE 0703 sensor available from The Fredricks Company of Huntingdon Valley, Pa. The sensor 346, as well as the control module 348, may be mounted on a bracket 360 and include an adjustment mechanism 362, such as a screw or other device, to help adjust the orientation of the sensor 346 relative to the bracket 360 and calibrate the sensor to a true level or other desired orientation.

During operation of the directional control apparatus 330, if the section of the door 102 positioned above the directional control apparatus 330 becomes out of plumb, the tilt sensor 346 would become out of level and generate a representative signal of such a state or condition. Upon generation of such an out-of-level signal, the steering actuator 350 may displace the drive rods 352 and turn the roller assemblies 344 in an appropriate direction to steer the directional control apparatus 330 such that the portion of the door 102 to which it is attached becomes displaced back to a plumb condition such as has previously been described with respect to other embodiments disclosed herein.

Once the section of the door 102 returns to a plumb orientation, the sensor 346 will sense that it is back to a level state (commensurate with the in-plumb orientation of the section of the door 102) and generate an appropriate signal such that the steering actuator 350 returns the roller assemblies 344 to a commensurate steering position. It is noted that the sensor 346 may be configured to produce a signal that corresponds with the out-of-plumb magnitude of the section of the door 102. In other words, if the section of the door 102 being monitored is only slightly out of plumb, then the roller assemblies 344 will only be adjusted a relatively small amount. On the other hand, if the section of the door 102 being monitored is grossly out of plumb, the roller assemblies 344 may experience a substantial displacement or reorientation in order to bring the section of the door 102 back into plumb more quickly and efficiently. Again, while the exemplary embodiment is described in terms of "plumb" and "out of plumb" the present invention may be used to detect an orientation of a section of the door 102 relative to plumb and reposition the section of the door, if necessary, to a specified orientation which may or may not be plumb.

In another embodiment, the relative position of a section of the door 102 along a defined pathway of the door 102 may be utilized to determine the magnitude of steering correction applied by the roller assemblies 344. In one example, the section of the door 102 being monitored may include the lead post 116 and the magnitude of steering correction to be provided by the roller assemblies in order to bring the lead post 116 back to a plumb state may vary depending on the distance remaining between the door post 116 and the structure with which it will eventually engage (e.g., the door post 118 of FIG. 1B). Thus, if a relatively short distance remains between the lead post 116 and the door post 118 with which it will engage, more aggressive steering correction may be implemented to ensure that the lead post 116 returns to plumb before it reaches the door post 118.

To assist in determining and controlling the magnitude of steering correction being applied by the roller assemblies 344, a rotational potentiometer or other sensor 370 may be coupled to a shaft 372 or other component of the roller assemblies 344 to determine the radial orientation of the roller assemblies 344 relative to an axis 374 about which such assemblies rotate. The information regarding the radial orientation, as determined by the potentiometer or other sensor 370, may be used to determine whether the applied steering correction is adequate for a given scenario, or whether additional steering correction is required.

In yet another embodiment, multiple sensors 346 may be used such that, for example, one sensor may be utilized in detecting the orientation of the door 102 (or section thereof) while it is being displaced in a first direction, (e.g., while deploying the door 102) and a second sensor may be utilized in detecting the orientation of the door 102 while it is being displaced in a second direction (e.g., while the door 102 is being opened or retracted). In one exemplary embodiment, a specified section of the door 102 may need to be placed in a first specific orientation while in a deployed state but in a second specified orientation, different from the first, while in a retracted state.

Referring now to FIGS. 10 and 11A-11C with general reference to FIGS. 1A-1C, an apparatus 400 for controlling the displacement of a movable partition is shown. The apparatus 400 includes a bracket 402 for mounting the apparatus 400 to a portion of a movable partition (e.g., such as to a portion of a door 102 shown in FIGS. 1A-1C). For example, the bracket 402 may have holes or apertures 404 formed therein and configured such that the bracket 402 may be coupled to a portion of a lead post 116 of a door 102 using appropriate fasteners. Of course, the bracket 402 may be configured for coupling to other portions of a door 102 and other techniques of attaching the bracket 402 or the apparatus 400 to the door 102 may be used as will be appreciated by those of ordinary skill in the art.

A sensor 446 or other device may be coupled to the bracket 402 and configured to determine an orientation of an associated door 102 (or at least a portion of the door 102) to which the apparatus 400 is attached. For example, the sensor 446 may be configured to determine whether a portion of the door 102 is substantially plumb or is out of plumb by more than a specified magnitude, such as has been described hereinabove. In one embodiment, the sensor 446 may include a tilt sensor such as described hereinabove. The sensor 446 may further be configured to generate and transmit an appropriate signal representative of the sensed orientation of the door (or portion thereof) to a control module, a system controller or some other device.

A frame member 406 is coupled to the bracket 402 such that the frame member 406 and the bracket 402 are movable with respect to one another within defined limits. For example, a pivoting joint 408 may join the two components together. In other embodiments, it is contemplated that the two components may be slidably coupled with respect to each other.

Various components may be coupled to, or otherwise associated with, the frame member 406. For example, a roller assembly 444 may be coupled to, or otherwise associated with, the frame member 406. As with previously described roller assemblies, the roller assembly 444 may be configured such that a wheel 456 rolls about a first axis 458 (a rolling axis) and rotates relative to the frame member 406 about a second axis 462 (a steering axis).

A control module 448 may also be coupled to or otherwise associated with the frame member 406. In another embodiment, the control module 448 may be mounted to the bracket 402, to some other component of the apparatus 400, or even remotely located relative to the apparatus 400 and, for example, coupled to a portion of a system 100. The control module 448 may include various processing devices, memory devices, or both. In one embodiment, the control module 448 may facilitate communication with a system controller that includes various processing devices and/or memory devices, such as has been discussed hereinabove with respect to other embodiments of the present invention.

A steering actuator 450 may be associated with the roller assembly 444 and configured to rotationally displace the wheel 456 about the second axis 462. The steering actuator 450 may include, for example, a stepper motor or a servo motor that is coupled to and configured to rotationally displace a shaft of the roller assembly 444. Of course other actuators may be utilized as will be appreciated by those of ordinary skill in the art.

During operation of the apparatus 400, if the section of the door 102 positioned above or otherwise associated with the apparatus 400 becomes out of plumb (or displaced relative to a reference orientation), the tilt sensor 446 will sense the change in orientation and generate a representative signal of such a state or condition. Upon receipt of such a signal from the control module 448 (or in other embodiments, for example, from the sensor 446 or from a system controller), the steering actuator 450 rotationally displaces the roller assembly 444 such that the wheel 456 steers the apparatus, and thus, the portion of the door 102 or partition to which it is attached, in a desired direction. When the sensor 446 senses that the portion of the door 102 to which the apparatus is attached is plumb or within an accepted tolerance of being plumb (or back to some other specified orientation), the sensor 446 will provide an appropriate signal (or, perhaps stop providing a signal) such that the steering actuator 450 returns the wheel to a predetermined steering orientation. The apparatus 400, thus, steers or displaces the portion of the door 102 to which it is attached back to a desired orientation (e.g., back to plumb) such as has been described with respect to other embodiments disclosed herein. In other embodiments, additional functions may be provided by the steering actuator 450 and roller assembly 444 such as steering the door 102 around a bend or curve or otherwise reorienting a portion of the door 102 such as has been described hereinabove.

In addition to the steering and reorienting features of the apparatus 400, the apparatus 400 also provides what may be termed a constant force mechanism 469. For example, still referring to FIGS. 10 and 11A-11C, the apparatus 400 may include a linear actuator 470, such as a linear stepper motor or other device, having one end thereof coupled to the bracket 402 such as, for example, by a pivoting member 472. In one embodiment, the linear actuator 470 may include a model S12-09A4 or S12-17AB actuator available from Thompson Industries, Inc. of NY.

The linear actuator 470 may include a linear displacement member such as a linearly displaceable shaft or cylinder 474 having an end thereof coupled to strut 476, or other structural member. The coupling of the cylinder 474 and strut 476 may be configured to accommodate relative pivoting or other movement of the two components. In one embodiment, the strut 476 may be formed as a component of the frame member 406 or may be otherwise coupled to the frame member 406. As will be described in further detail hereinbelow, actuation of the linear actuator 470 results in displacement of the strut 476, frame member 406 and various components that may be coupled with the frame member 406.

Figure 11A:
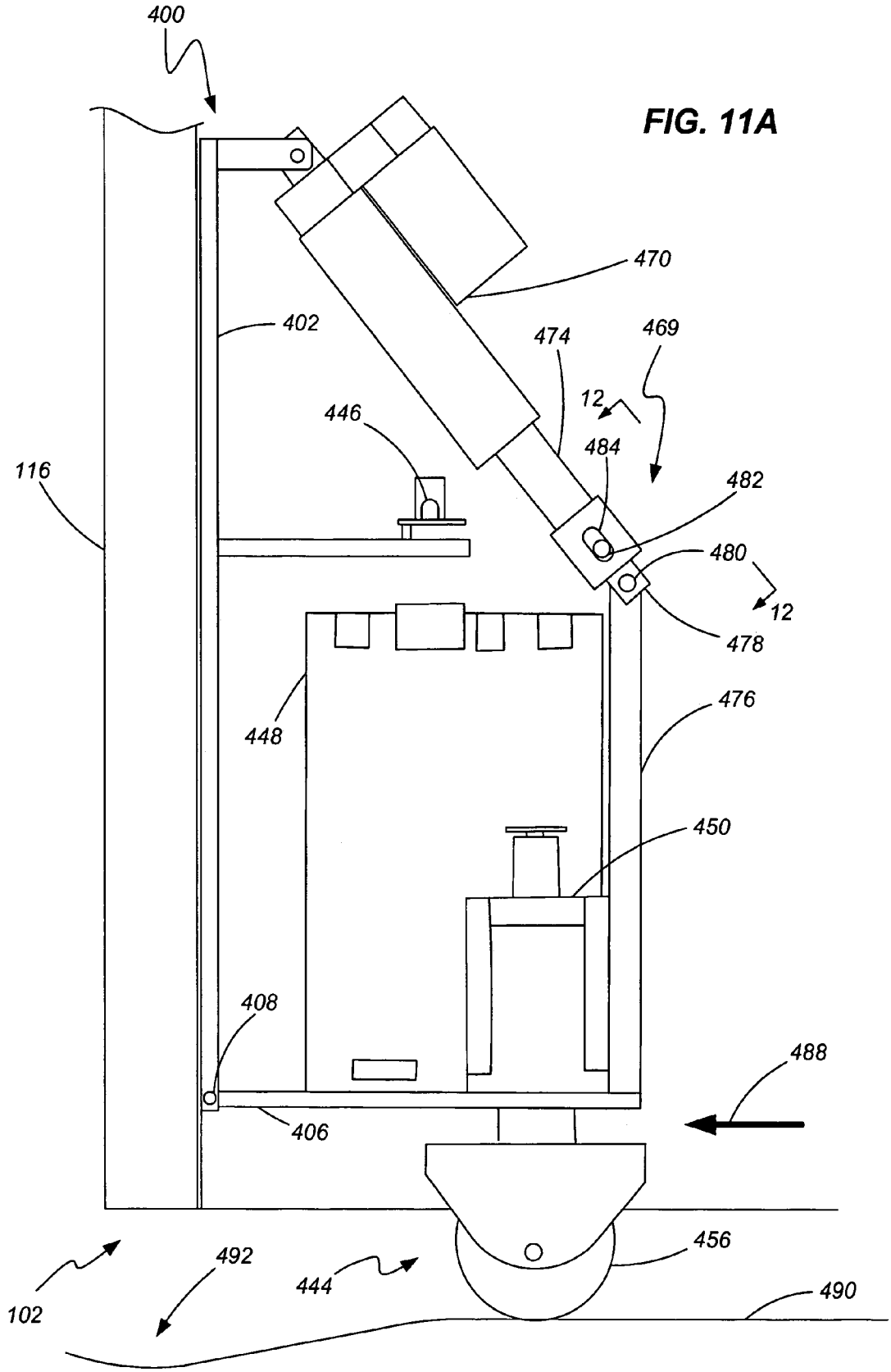
FIGS. 11A through 11C are side views of the apparatus shown in FIG. 10 coupled with a portion of a movable partition during different operational states or stages.
Figure 11B:
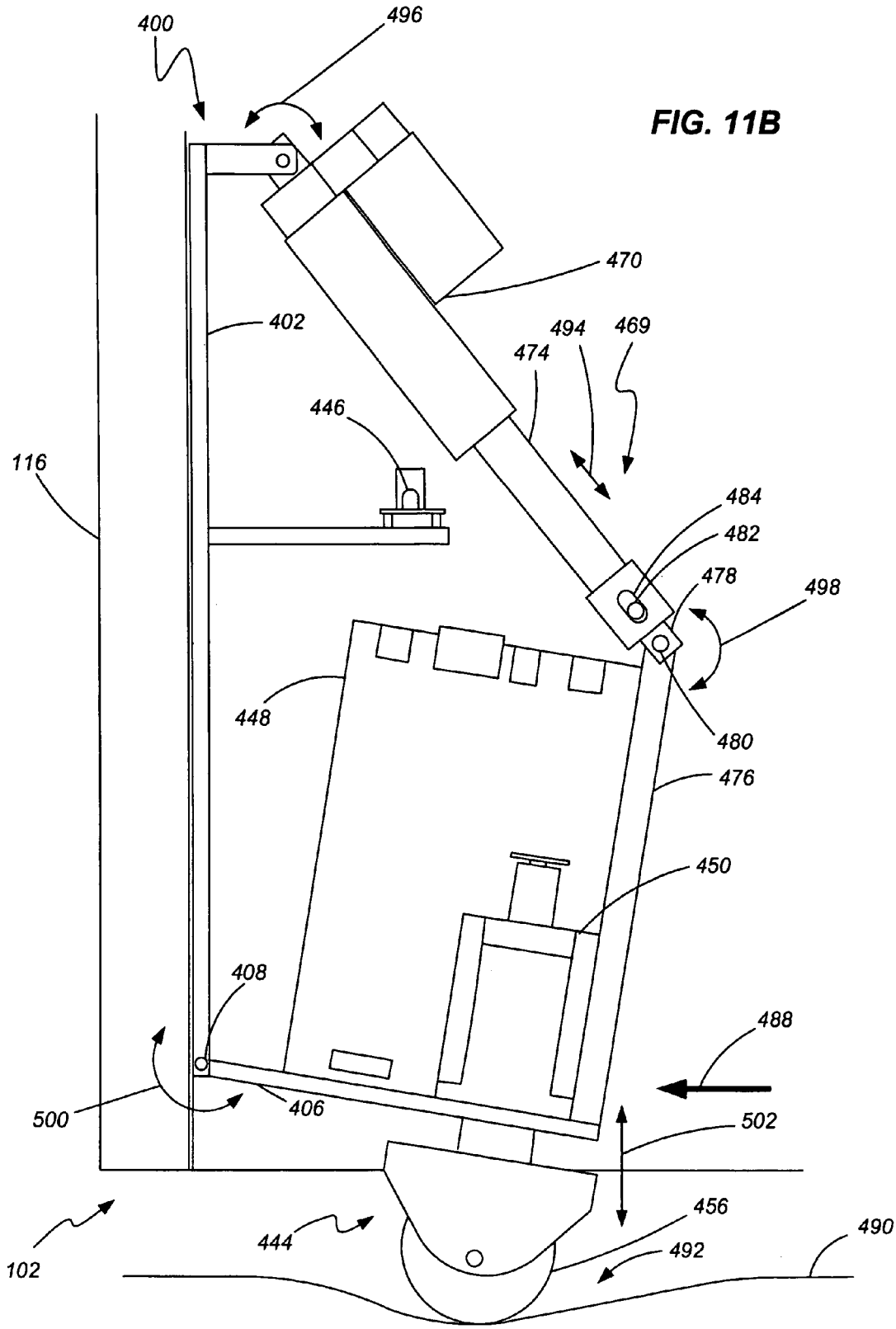
Figure 11C:
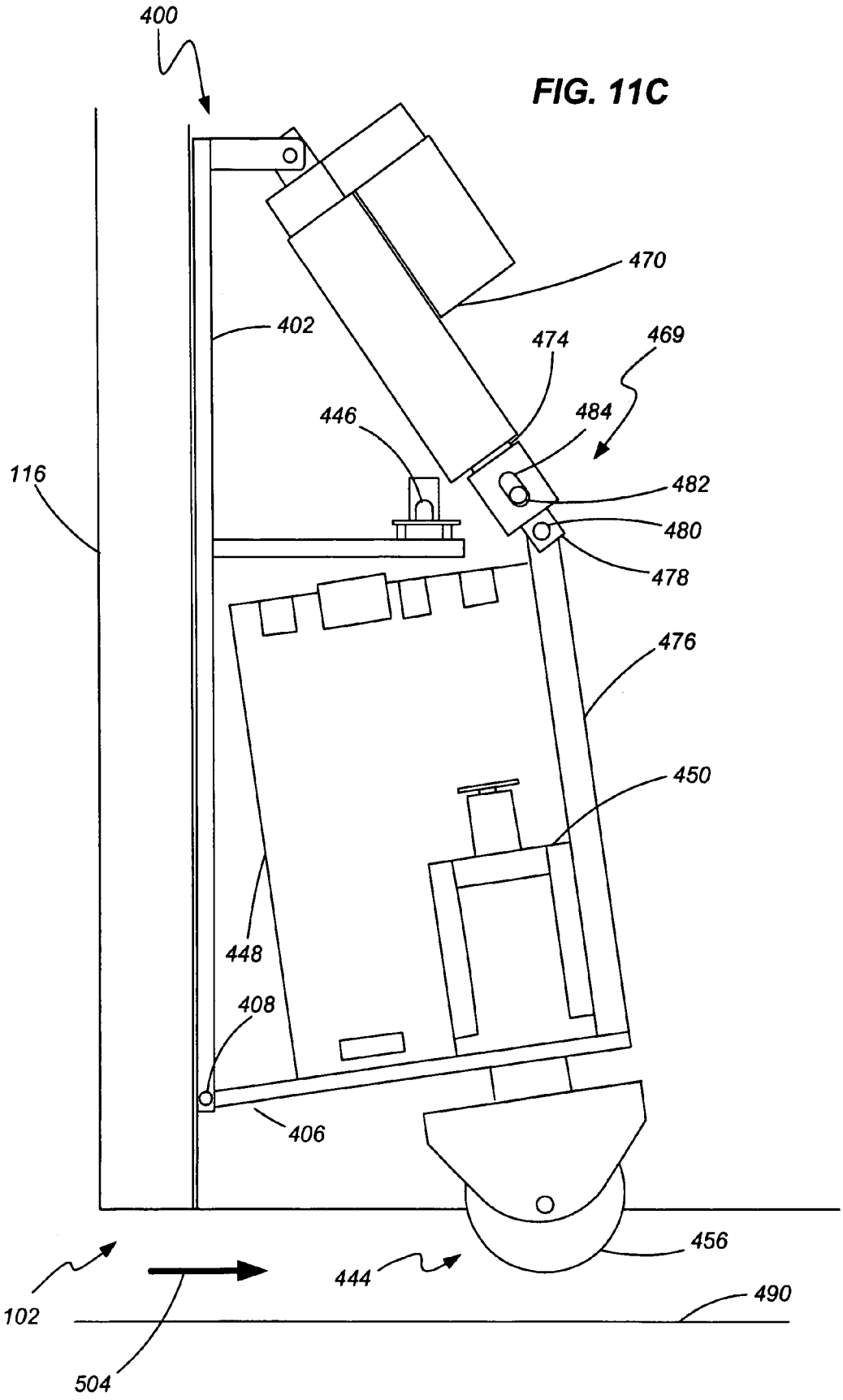
Figure 12:
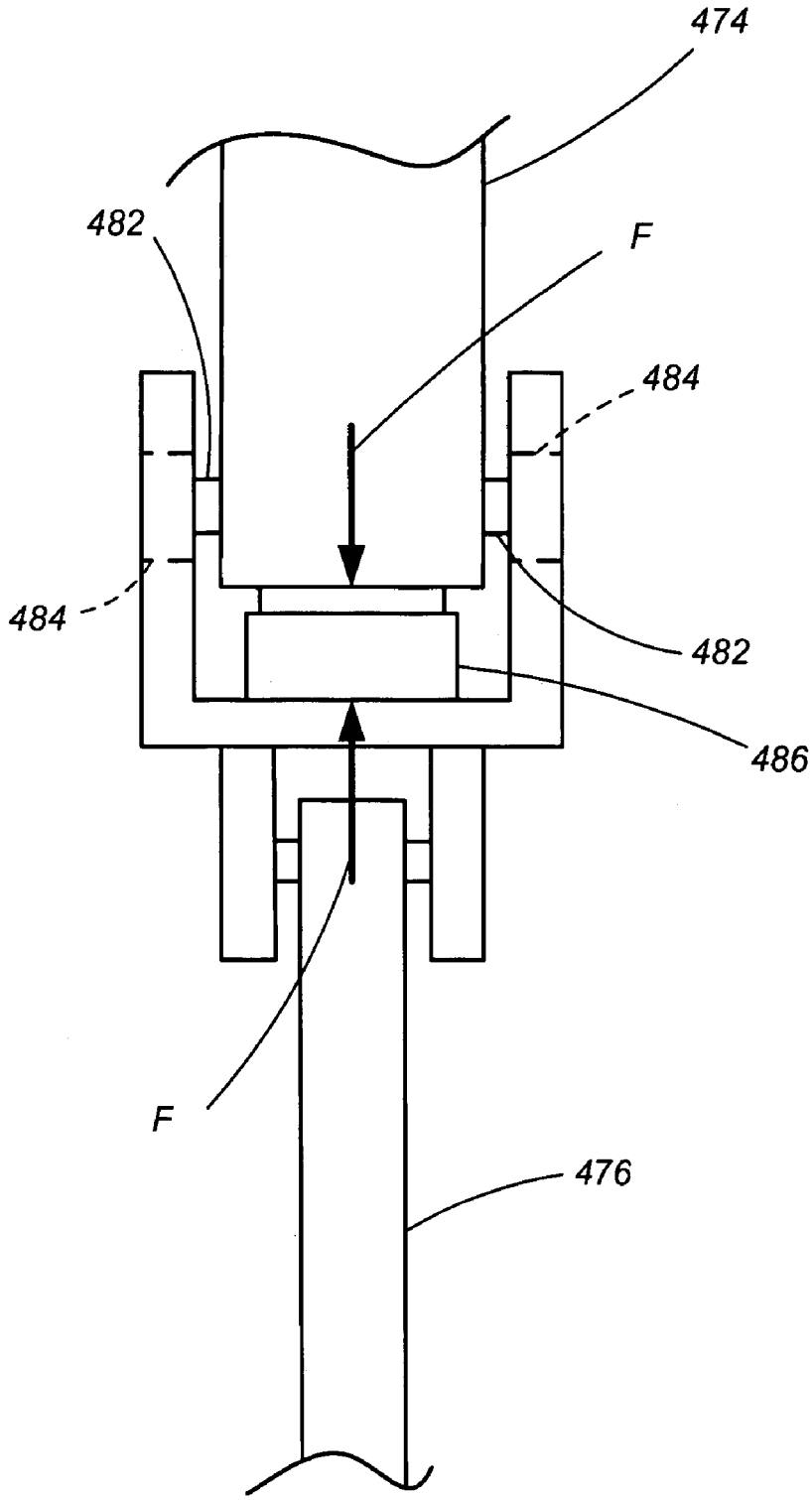
FIG. 12 is a detailed view of a portion of the apparatus shown in FIGS. 10 and 11A-11C.

Referring briefly to FIG. 12 in conjunction with FIGS. 10 and 11A-11C, a bracket 478, such as a yoke-type member, may be used to couple the linear actuator 470 with the strut 476. In one embodiment, the bracket 478 may be coupled to the strut member 476 by a pivoting member 480. The cylinder 474 (or other component of the linear actuator 470) may be coupled to the bracket 478, for example, by way of one or more pins 482 or other fasteners. In one embodiment, a pin 482 (or pins) is coupled to the cylinder 474 and extends into slots 484 formed in the bracket 478. The slots 484 are sized and configured to permit movement of the pin(s) 482 within the slots 484 a desired distance and in a desired direction (e.g., in the same direction as the longitudinal axis of the cylinder 474).

In the embodiment described with respect to FIG. 12, a load sensor 486 is disposed between an end of the cylinder 474 and a portion of the bracket 478. The load sensor 486 may include a compressive force transducer configured to determine the compressive force "F" being applied between the cylinder 474 and the bracket 478 as indicated on FIG. 11. In one embodiment, a suitable load sensor 486 may include a FLEXIFORCE® sensor available from Tekscan, Inc., of South Boston, Mass. As noted above, the pin-and-slot (482 and 484) configuration enables relative displacement of the cylinder 474 and bracket 478 so that the force F may vary between the two components, the load sensor 486 being configured to detect the changing force between such components.

The load sensor 486 may further be configured to provide a signal indicative of the magnitude of the force F sensed thereby (or, in another embodiment, the magnitude of a change in the force F sensed thereby) and transmit the signal to the control module 448, to a system controller or to another device (e.g., the linear actuator 470). If, for example, the load sensor 486 transmits a signal to the control module 448, the control module may, in accordance with specified operating parameters, transmit an appropriate signal to the linear actuator 470 such that the linear actuator 470 adjusts (e.g., extend or retract the cylinder 474) based on the sensed load or sensed change in load.

It is noted that other configurations may be employed to detect or determine the magnitude of a force being applied to a roller assembly 444 as it is pressed against a surface over which it is rolling. In one embodiment, one ore more strain gages may be utilized to determine changes in strain, for example, at a location of connection between the strut 476 and the frame member 406. An example of one suitable strain gage includes those commercially available from Vishay Intertechnology, Inc., of Malvern, Pa., currently offered as Micro-Measurements CEA-06-125UN-350.

As indicated in FIG. 11B, when the cylinder 474 extends or retracts as indicated by directional arrow 494, the linear actuator 470 pivots relative to the bracket 402 as indicated by directional arrow 496, the cylinder 474 and strut 476 pivot relative to each other as indicated by directional arrow 498, and the frame member 406 pivots relative to the bracket 402 as indicated by directional arrow 500. These relative movements of various components cause the roller assembly, and more particularly, the wheel 456 to change elevation relative to the bracket 402 as indicated by directional arrow 502.

Such a configuration may be used to maintain a substantially constant load (or a load within a specified range) between the portion of the bracket 402 to which the linear actuator 470 is attached and the surface supporting the wheel 456, via the linear actuator 470, the strut 476, the frame member 406 and associated roller assembly 444.

In operation, as the apparatus 400 traverses a surface, such as when the door 102 or movable partition to which is attached is being deployed, the constant force mechanism 469 enables the wheel 456 of the roller assembly 444 to maintain a constant force against the surface on which in it is rolling even though the surface may be relatively uneven and exhibit undulations (such as "peaks" and "valleys") along the path of the door 102 or movable partition.

For example, referring more specifically to FIGS. 11A-11C, an apparatus 400 coupled to the lead post 116 of a door 102 is shown in various states of operation. In FIG. 11A, the apparatus 400 is in first state of operation such that, as the door 102 is being deployed (i.e., the lead post 116 and apparatus 400 are traveling in the direction indicated by directional arrow 488), the wheel 456 is in contact with an adjacent or an underlying surface (referred to herein as an adjacent surface 490) such as a floor. The linear actuator 470 is positioned to apply a specified force to the strut 476, the force being transmitted through the frame member 406, the roller assembly 444 and, thus, the wheel 456. However, the adjacent surface 490 may include a substantially nonplanar surface feature which is shown in the present example as valley 492.

Referring to FIG. 11B, as the wheel 456 traverses the portion of the adjacent surface 490 that includes the valley 492, the load sensor 486 (FIG. 12) senses that the load has diminished (due to the change in the geometrical relationship between the wheel 456 and the adjacent surface 490). The linear actuator 470 then adjusts such that, in this particular case, the cylinder 474 extends causing the various components to move relative to each other, as described above, and causing the wheel 456 to maintain contact with the underlying surface 490 as it traverses the valley 492. Not only does the wheel 456 maintain contact with the adjacent surface 490 as it traverses the valley 492, it also maintains a substantially constant force (or, in another embodiment, maintains the force within a specified range) between the wheel 456 and the adjacent surface 490. For example, a force of approximately 50 pounds may be maintained between the wheel 456 and the adjacent surface 490. Of course the amount of force maintained between the wheel 456 and the adjacent surface 490 may be determined, at least in part, on the materials from which the wheel 456 and adjacent surface 490 are formed, the specific application of the associated door 102 (e.g., the amount of anticipated lateral loading to be experienced by the door 102) and other related conditions of the local environment. As such, the amount of force being applied by the wheel 456 to the adjacent surface 490 (or the range of force) may be adjusted to accommodate various conditions if desired.

As the apparatus 400 continues in the direction indicated by directional arrow 488, the wheel 456 encounters a further elevational change in the adjacent surface 490 as it leaves the valley 492. The constant force mechanism 469 will again detect the elevational change, such as by sensing an increased load as the wheel 456 experiences the elevational change, and then again adjusting the elevation of the wheel 456 to accommodate the change in the adjacent surface 490.

Maintaining contact between the wheel 456 and the adjacent surface 490 provides various benefits. First, if the roller assembly 444 is coupled to a steering actuator 450 such as has been described herein, the steering actuator 450 will become ineffective during any period of time during which the wheel 456 breaks contact with an adjacent surface 490 since contact or friction is required for the wheel 456 to "steer" the apparatus 400 and associated portion of the door 102 in a desired direction.

Additionally, as previously discussed, various external forces may be applied to a door 102 during deployment thereof. Maintaining contact between the wheel 456 and an adjacent surface 490 (such as the floor of a building) with a specified force, or within a specified force range, acts to prevent external loads from laterally displacing the door 102, or at least the portion with which the apparatus 400 is associated. More specifically, as previously discussed, the upper portion of the door 102 is substantially laterally fixed due to its coupling with a track 114 (FIGS. 1A-1C). The application of a force between the wheel 456 and an adjacent surface 490, due to friction therebetween, resists displacement at the lower edge of the door 102. If contact between the wheel 456 and the adjacent surface is broken, or if the load being applied between the wheel 456 and the adjacent surface 490 is reduced below a desired level, the friction between the wheel 456 and adjacent surface 490 will not be sufficient to prevent external forces of any substantial magnitude.

Referring now to FIG. 11C, in various circumstances, when the door 102 is being retracted, as indicated by directional arrow 504, it may not be necessary, or even desirable in some instances, to laterally restrict the position of the door 102. Thus, as shown in FIG. 11C, the constant force mechanism 469 may be placed in a retracted state such that the wheel 456 is displaced away from the adjacent surface 490 and never makes contact therewith. Such a configuration may be advantageous, for example, when the opening for a pocket 108 (FIGS. 1A-1C) is out of alignment with a corresponding jamb or door post 118 (FIGS. 1A-1C) such as has been previously described. Retraction of the wheel 456 from the adjacent surface enables the lead post 116 to be freely displaced laterally that it may automatically align with the pocket 108 when it returns to a retracted or stored condition.

While the embodiment shown in FIGS. 10, 11A-11C and 12 have been described as including various components that pivot relative to one another to effect a displacement of the wheel 456 and a desired application of force between the wheel 456 and an adjacent surface 490, it is noted that other configurations are contemplated. For example, while not specifically shown, a linear actuator may be coupled to a frame member, or even directly to a roller assembly, such that a substantially linear, sliding displacement of the wheel 456 is effected relative to an associated bracket (e.g., bracket 402) or other structural component. Additionally, various types of linear actuators may be used including, for example, pneumatic cylinders, hydraulic cylinders, jack screws, or the like. Moreover, in other embodiments, various configurations may include actuators other than linear actuators. Thus, it will be appreciated by those of ordinary skill in the art that various configurations may be used to maintain application of a desired force between the wheel 456 and an adjacent surface 490.

Figure 13A:
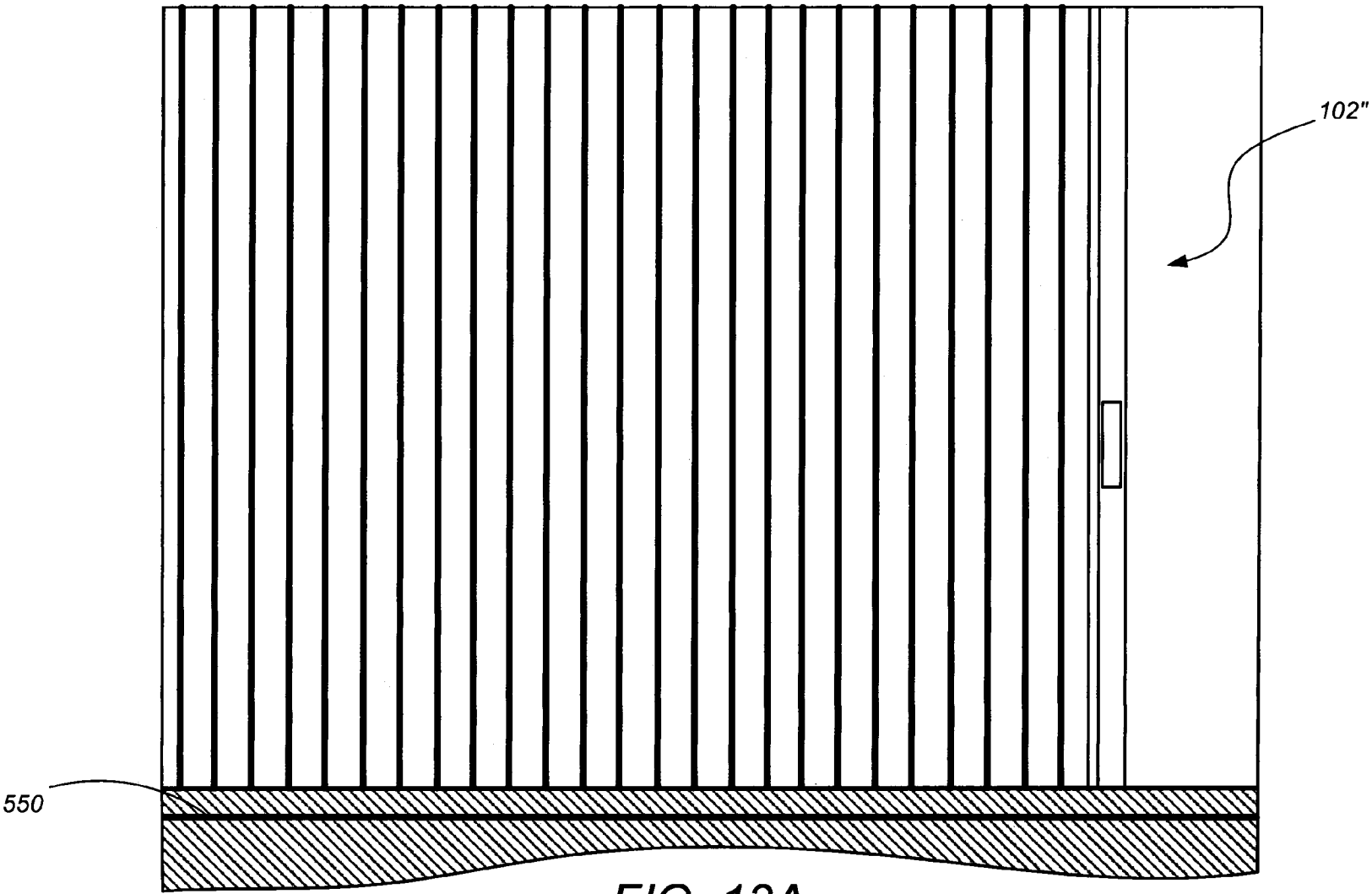
FIGS. 13A and 13B are partial cross-sectional side and front views, respectively, of another apparatus for directionally controlling a movable partition in accordance with yet another embodiment of the present invention.
Figure 13B:
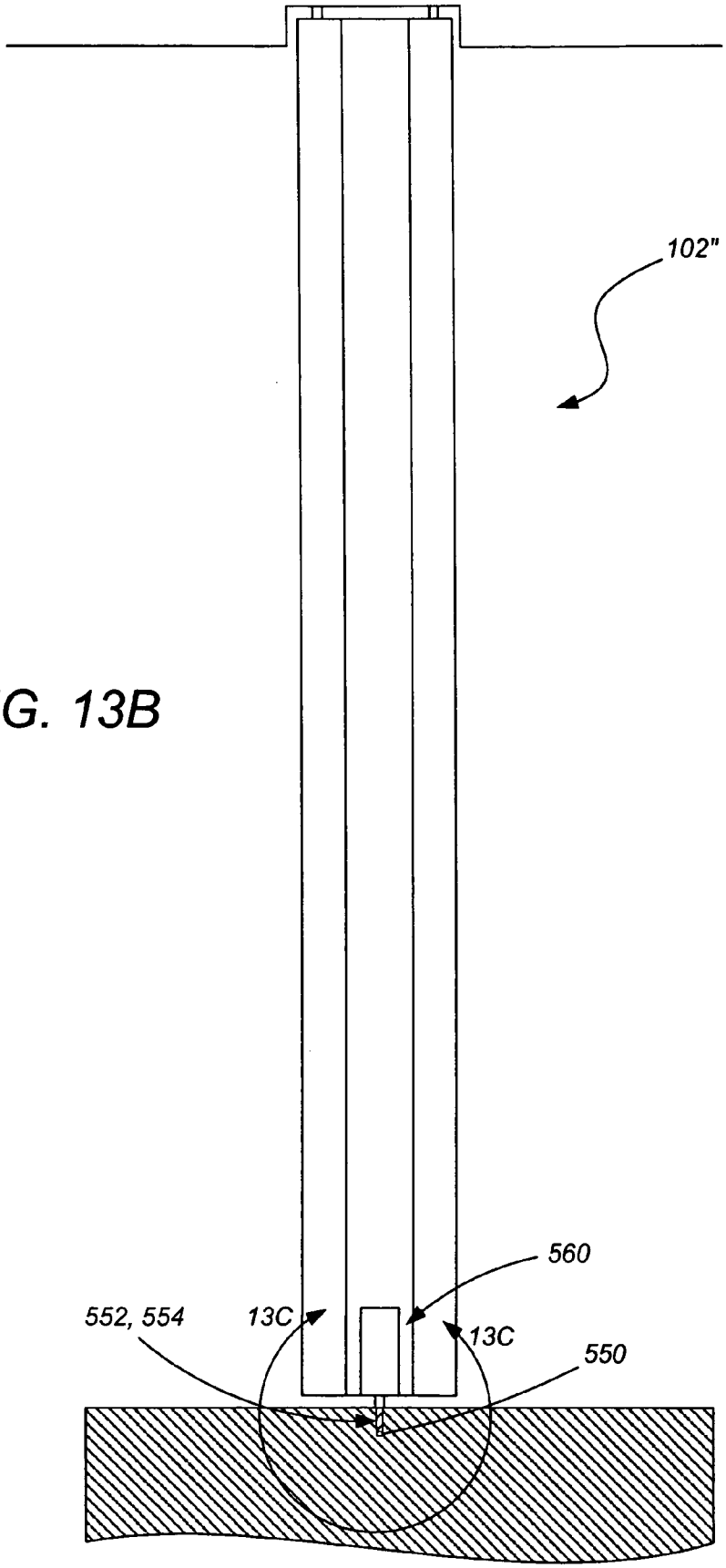
Figure 13C:
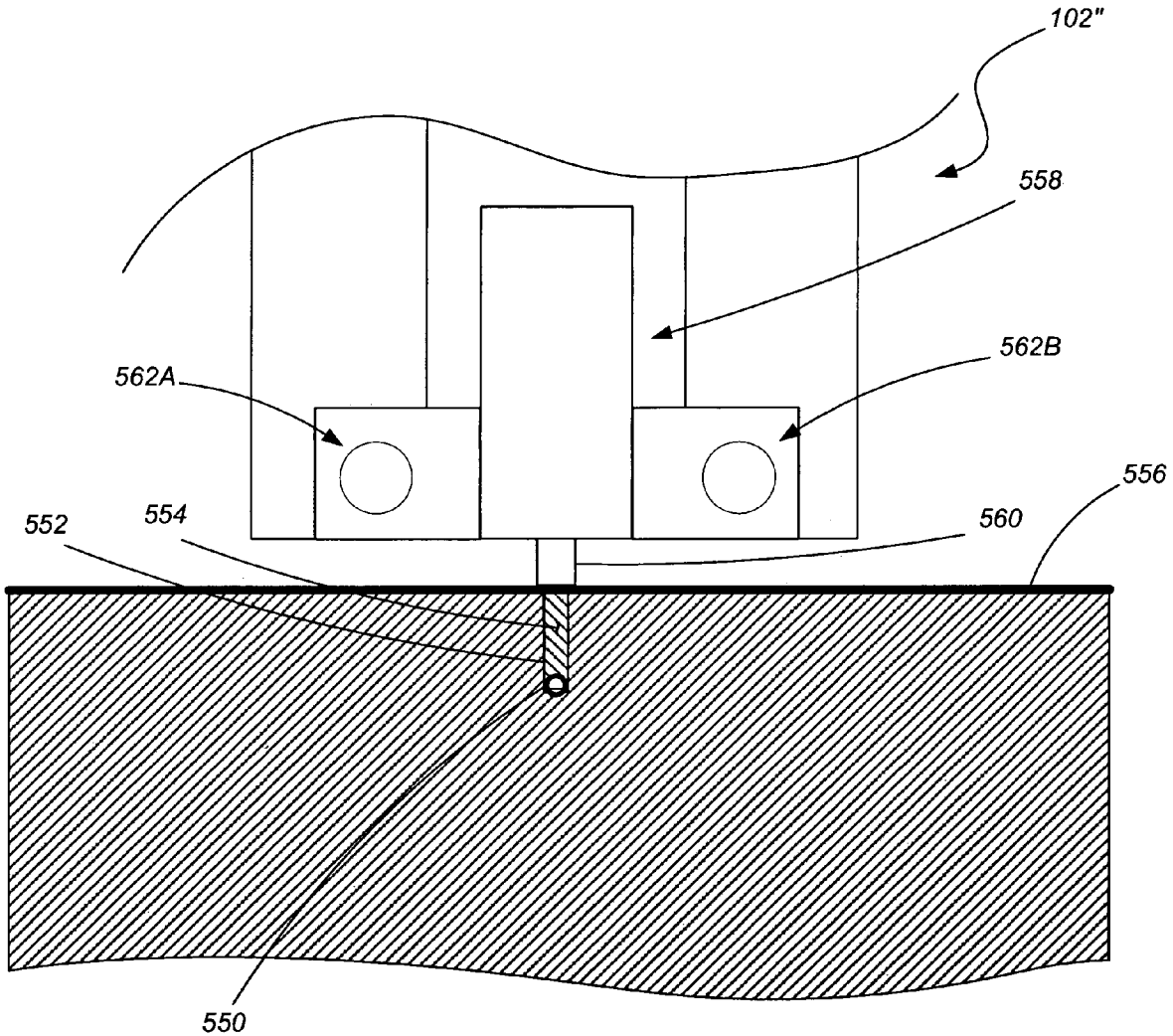
FIG. 13C is an enlarged detailed view of a portion of the apparatus shown in FIG. 13B.

Referring now to FIGS. 13A through 13C, a schematic view of a movable partition, such as a door 102", in accordance with another embodiment of the present invention is shown. A component capable of generating a magnetic field is disposed in a structure (e.g., below an exposed surface of a floor) along a path that the door 102" is intended to travel. The magnetic field generating component may include, for example, a ferromagnetic structure, a conductive wire through which an electrical current (e.g., an alternating current) is passed, or some other electromagnetic structure and will be referred to herein as a conductor 550 for sake of convenience.

In one example, a groove 552 may be formed in a floor (or other structure) along the intended or desired path of the door 102" and the conductor 550 may be disposed in the groove 552. The groove 552 may be filled with a nonmagnetic component 554 (e.g., cement or epoxy) and a floor covering 556 placed over the floor and filler material (see, e.g., FIG. 13C). Such a floor covering 556 might include any standard floor covering including, for example, carpet, wood, tile, vinyl, laminate or the like.

A directional control apparatus 558, which may include one or more wheels 560 and one or more steering actuators (not shown in FIGS. 13A-13C), such as has been previously described, is coupled to a portion of the door 102" at a desired location. For example, the directional control apparatus 558 may be coupled with or near a lead post of the door 102". The directional control apparatus 558 further includes one or more magnetic sensors 562A and 562B.

In one embodiment, a first magnetic sensor 562A is laterally positioned on a first side of the conductor 550 and a second magnetic sensor 562B is laterally positioned on an opposing side of the conductor 550. As the directional control apparatus 558 (and the portion of the door 102" to which it is coupled) is laterally displaced relative to the conductor (and, thus, laterally displaced relative to its intended path or orientation), one of the magnetic sensors detects the presence of a magnetic field from the conductor 550, or the change in strength of the magnetic field, and causes the directional control apparatus 558 to steer door 102" back into its desired position.

For example, looking at FIGS. 13B and 13C, if the door 102" were to be laterally displaced to the right, the first magnetic sensor 562A would become displaced such that it was in closer proximity to the conductor 550 and the second magnetic sensor 562B would become displaced such that it was further away from the conductor 550 than when in an intended operating orientation. The first magnetic sensor 562A might detect the presence of the magnetic field produced by the conductor 550, or it might sense an increase in the strength of the magnetic field, and then communicate such detection with an appropriate component of the directional control apparatus 508 such as a controller for a steering actuator.

In another embodiment, while still considering the example of the door 102" as viewed in FIGS. 13B and 13C being displaced to the right, the second magnetic sensor 562B might detect a weakening of the magnetic field, based on its displacement away from the conductor 550, and provide a signal representative of that determination. In either case, after detecting the lateral displacement of the door 102" relative to the conductor 550, the directional control apparatus could actuate a steering actuator so as to bring the door 102" back to a desired orientation in a manner similar to that which has been previously described herein.

Figure 14:
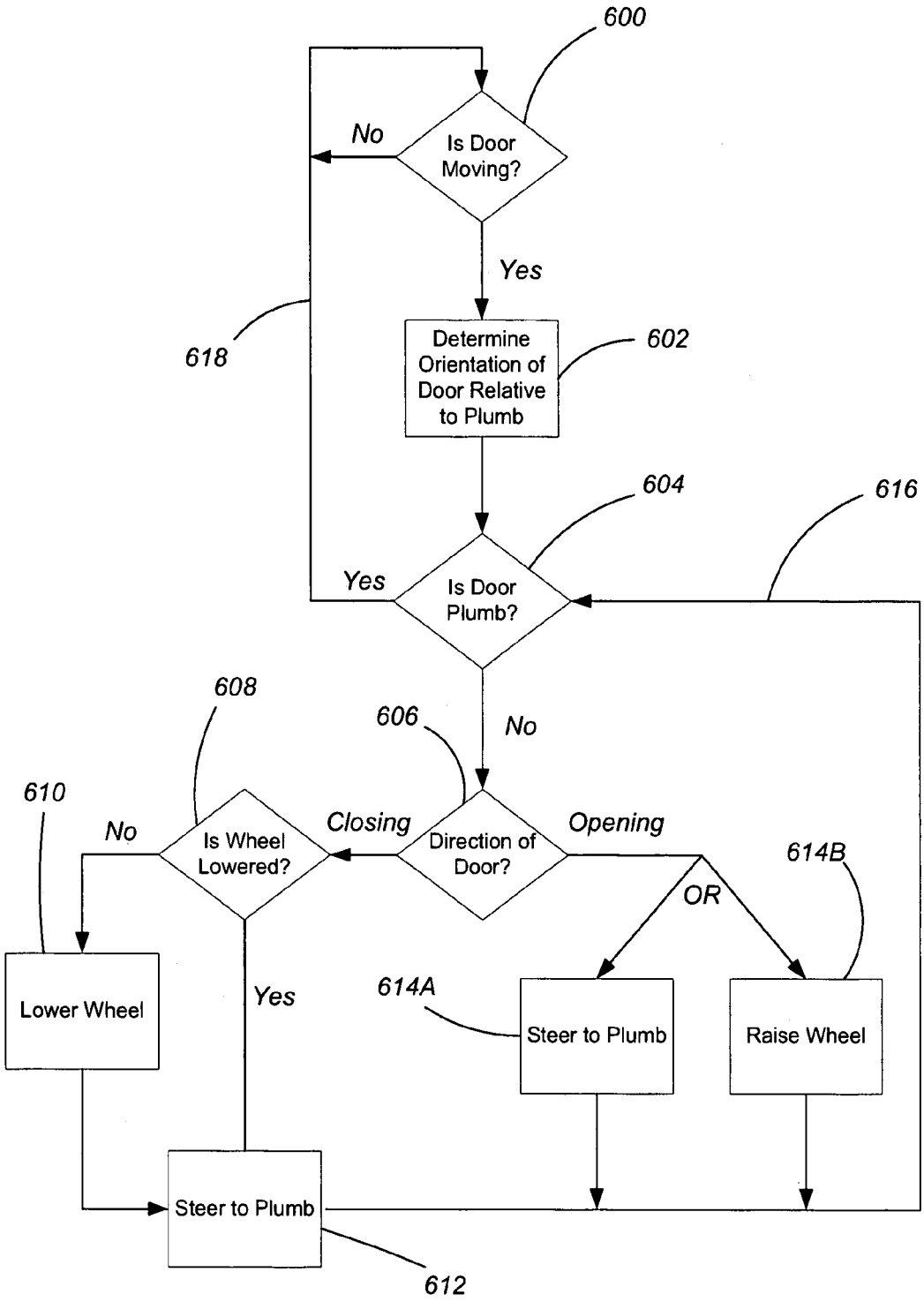
FIG. 14 is a flow chart depicting a method of controlling a movable partition in accordance with another embodiment of the present invention.

Referring now to FIG. 14, another method of operating a door 102 (FIG. 1) or other movable partition may include determining whether the door 102 is moving as indicated at 600. If the door 102 is moving, the orientation of the door 102 relative to plumb (or some other reference standard) may be determined as indicated at 602 and 604. If the door is not plumb (or otherwise within a specified range of tolerance relative to a reference orientation), the direction of the door 102 may be determined as indicated at 606. If the door 102 is closing (i.e., extending across a space to form a barrier), then it may be determined if the wheel (e.g., wheel 456 or wheel 510) is lowered or otherwise displaced such that the wheel is in engagement with the adjacent surface (e.g., adjacent surface 490) as indicated at 608. If the wheel is not lowered (or in the desired position), it may then be displaced to engage the adjacent surface as indicated at 610. With the wheel in proper position, the door 102 (or portion thereof) may be steered back to the desired orientation (e.g., back to plumb) as indicated at 612.

If the door 102 is determined to be opening and the door 102 is also determined to be out of plumb, the door 102 may either be steered back to plumb as indicated at 614A or the wheel may simply be raised so that it no longer contacts the floor or other adjacent surface as indicated at 614B and as has been previously discussed herein. The process may then continue as indicated by loop 616 or by way of loop 616 combined with loop 618.

While the invention may be susceptible to various modifications and alternative forms, specific embodiments have been shown by way of example in the drawings and have been described in detail herein. However, it should be understood that the invention is not intended to be limited to the particular forms disclosed. It is also noted that various features of any of the described embodiments may be combined with features of other described embodiments as will be apparent to those of ordinary skill in the art. The invention, therefore, includes all modifications, equivalents, and alternatives falling within the spirit and scope of the invention as defined by the following appended claims.

What is claimed is:

1. An automatic door comprising:

at least one partition including a plurality of hingedly coupled panels;

a drive configured to motivate the at least one partition along a defined pathway; and an apparatus coupled to a lower edge of the at least one partition, the apparatus comprising:

at least one roller assembly comprising at least one roller element;

an actuator operatively coupled with the at least one roller assembly and configured to selectively alter the position of the at least one roller element relative to the lower edge of the at least one partition; and at least one sensor configured to determine a magnitude of a force applied between the actuator and the at least one roller assembly.

2. The automatic door of claim 1, further comprising a controller in communication with the at least one sensor and the actuator, the controller being configured to control actuation of the actuator responsive, at least in part, to information provided from the at least one sensor.

3. The automatic door of claim 1, wherein the apparatus further comprises a mounting bracket coupled with the lower edge of the at least one partition and a frame member movably coupled with the mounting bracket, wherein the at least one roller assembly is coupled with the frame member.

4. The automatic door of claim 3, wherein the frame member is pivotally coupled with the mounting bracket and wherein the actuator is configured to selectively, pivotally displace the frame member and the at least one roller assembly relative to the mounting bracket.

5. The automatic door of claim 4, wherein the actuator comprises a linear actuator.

6. The automatic door of claim 5, further comprising a steering actuator operably coupled with the at least one roller assembly and configured to rotationally displace the at least one roller element about a steering axis.

7. The automatic door of claim 6, wherein the apparatus is located and configured to position the at least one roller element in contact with a surface adjacent the lower edge of the at least one partition.

8. The automatic door of claim 7, wherein the linear actuator is operably coupled to a strut associated with the frame member.

9. The automatic door of claim 8, wherein the at least one sensor is disposed between a portion of the strut and a portion of the linear actuator.

10. The automatic door of claim 7, wherein the linear actuator selectively displaces the at least one roller element responsive, at least in part, to a signal generated by the at least one sensor.

11. The automatic door of claim 10, wherein the linear actuator is configured to maintain application of a specified force between the at least one roller element and the adjacent surface.

12. The automatic door of claim 1, wherein the at least one partition includes a first partition and a second partition laterally spaced from the first partition.

13. The automatic door of claim 12, further comprising a lead post coupled to a leading edge of the first partition and a leading edge of the second partition.

14. The automatic door of claim 13, wherein the at least one roller assembly is located adjacent the lead post.

15. The automatic door of claim 14, wherein the first partition and the second partition each include a plurality of hingedly coupled panels.

16. An automatic door comprising:

at least one partition coupled to an overhead track;

a drive configured to motivate the at least one partition along the overhead track; and an apparatus coupled to a lower edge of the at least one partition, the apparatus comprising:

at least one roller assembly comprising at least one roller element;

an actuator operatively coupled with the at least one roller assembly and configured to selectively alter the position of the at least one roller element relative to the lower edge of the at least one partition;

at least one sensor configured to determine a magnitude of a force applied between the actuator and the at least one roller assembly;

a steering actuator operably coupled with the at least one roller assembly and configured to rotationally displace the at least one roller element about a steering axis;

at least one additional sensor located and configured to determine an orientation relative to vertical of at least a portion of the at least one partition and generate a signal representative thereof; and a controller configured to receive the signal from the at least one additional sensor and to selectively control operation of the steering actuator in response to the signal from the at least one additional sensor.

* * * * *